US006900729B2

(12) United States Patent
Paximadis et al.

(10) Patent No.: US 6,900,729 B2
(45) Date of Patent: May 31, 2005

(54) THERMAL SIGNATURE INTENSITY ALARMER

(75) Inventors: John Matthew Paximadis, Westlake, OH (US); Richard Pettegrew, Parma Heights, OH (US)

(73) Assignee: Innovative Engineering & Consulting Corp.

( * ) Notice: Subject to any disclaimer, the term of this patent is extended or adjusted under 35 U.S.C. 154(b) by 0 days.

(21) Appl. No.: 10/390,225

(22) Filed: Mar. 17, 2003

(65) Prior Publication Data

US 2004/0183679 A1 Sep. 23, 2004

(51) Int. Cl.[7] ..... G08B 13/00
(52) U.S. Cl. ..... 340/565; 340/937; 348/314
(58) Field of Search ..... 340/565, 567, 340/937; 348/149, 164, 169, 314, 323; 382/103, 104; 250/339.14, 339.15, 342

(56) References Cited

U.S. PATENT DOCUMENTS 5,008,543 A * 4/1991 Bertrand et al. ..... 250/342
5,481,622 A * 1/1996 Gerhardt et al. ..... 382/103
6,384,414 B1 * 5/2002 Fisher et al. ..... 250/339.14
6,411,328 B1 * 6/2002 Franke et al. ..... 348/149

OTHER PUBLICATIONS

Accessed www.vistascape.com/products.htm on Feb. 12, 2004, A Radically Different Approach, Vistascape Security Systems, USA.

* cited by examiner

*Primary Examiner*—Van T. Trieu
(74) *Attorney, Agent, or Firm*—Calfee, Halter & Griswold LLP

(57) ABSTRACT

A system for processing thermal signature data is provided. The system provides a thermal signature data processor that analyzes one or more pixels to determine whether an aspect of an alarm-worthy event has occurred. In one example, the system additionally analyzes visual data in relation to the thermal signature data to determine whether an alarm-worthy event (e.g., intrusion) has occurred.

52 Claims, 22 Drawing Sheets

THERMAL SIGNATURE INTENSITY ALARMER

TECHNICAL FIELD

The systems, methods, application programming interfaces (API), graphical user interfaces (GUI), and computer readable media described herein relate generally to intrusion detection and more particularly to analyzing thermal signature data.

BACKGROUND

Motion detection by visual processing is well known in the art. For example, U.S. Pat. No. 6,504,479 discloses various systems and methods for motion detection. Similarly, thermal imaging via infrared (IR) is well known in the art. For example, an intruder alert system that employs IR is described in U.S. Pat. No. 5,825,413. Each, however, suffers from drawbacks that produce sub-optimal motion detection and/or intruder alert systems.

Conventional systems, particularly those employed in a visually noisy environment, may generate false positives (e.g., false alarms). For example, a motion detector outside a barn door may trigger an alarm due to the activity of a raccoon, or, on a windy night, when a tarpaulin covering a nearby woodpile flaps in the wind. Similarly, a heat detector inside a warehouse may trigger an alarm due to the activity of a rat, or a motion detector may alarm when the air conditioning system engages and blows scrap paper across the detection system field of view. False alarms may also be generated due to changing light conditions that produce apparent motion and/or thermal signature changes. By way of illustration, the rising sun may generate a thermal signature change directly and/or in items reflecting the sun. Furthermore, shadows and refractions may cause thermal signature changes.

SUMMARY

The following presents a simplified summary of methods, systems, computer readable media and so on for analyzing thermal signature data to facilitate providing a basic understanding of these items. This summary is not an extensive overview and is not intended to identify key or critical elements of the methods, systems, computer readable media, and so on or to delineate the scope of these items. This summary provides a conceptual introduction in a simplified form as a prelude to the more detailed description that is presented later.

In one example, a system operates with IR camera signals to provide thermal signature intensity alarming. In another example, a system operates with IR camera signals to provide motion detection. In yet another example, a system combines IR camera signal thermal signature intensity alarming with IR camera signal motion detection. In yet another example, intrusion detecting systems and methods combine visual processing with thermal signature processing.

Certain illustrative example methods, systems, computer readable media and so on are described herein in connection with the following description and the annexed drawings. These examples are indicative, however, of but a few of the various ways in which the principles of the methods, systems, computer readable media and so on may be employed and thus are intended to be inclusive of equivalents. Other advantages and novel features may become apparent from the following detailed description when considered in conjunction with the drawings.

Lexicon

As used in this application, the term "computer component" refers to a computer-related entity, either hardware, firmware, software, a combination thereof, or software in execution. For example, a computer component can be, but is not limited to being, a process running on a processor, a processor, an object, an executable, a thread of execution, a program and a computer. By way of illustration, both an application running on a server and the server can be computer components. One or more computer components can reside within a process and/or thread of execution and a computer component can be localized on one computer and/or distributed between two or more computers.

"Computer communications", as used herein, refers to a communication between two or more computer components and can be, for example, a network transfer, a file transfer, an applet transfer, an email, a hypertext transfer protocol (HTTP) message, a datagram, an object transfer, a binary large object (BLOB) transfer, and so on. A computer communication can occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, and so on.

"Logic", as used herein, includes but is not limited to hardware, firmware, software and/or combinations of each to perform a function(s) or an action(s). For example, based on a desired application or needs, logic may include a software controlled microprocessor, discrete logic such as an application specific integrated circuit (ASIC), or other programmed logic device. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Signal", as used herein, includes but is not limited to one or more electrical or optical signals, analog or digital, one or more computer instructions, a bit or bit stream, or the like.

"Software", as used herein, includes but is not limited to, one or more computer readable and/or executable instructions that cause a computer, computer component, and/or other electronic device to perform functions, actions and/or behave in a desired manner. The instructions may be embodied in various forms like routines, algorithms, modules, methods, threads, and/or programs. Software may also be implemented in a variety of executable and/or loadable forms including, but not limited to, a stand-alone program, a function call (local and/or remote), a servelet, an applet, instructions stored in a memory, part of an operating system or browser, and the like. It is to be appreciated that the computer readable and/or executable instructions can be located in one computer component and/or distributed between two or more communicating, co-operating, and/or parallel processing computer components and thus can be loaded and/or executed in serial, parallel, massively parallel and other manners. It will be appreciated by one of ordinary skill in the art that the form of software may be dependent on, for example, requirements of a desired application, the environment in which it runs, and/or the desires of a designer/programmer or the like.

An "operable connection" (or a connection by which entities are "operably connected") is one in which signals, physical communication flow, and/or logical communication flow may be sent and/or received. Usually, an operable connection includes a physical interface, an electrical interface, and/or a data interface, but it is to be noted that an operable connection may consist of differing combinations of these or other types of connections sufficient to allow operable control.

"Data store", as used herein, refers to a physical and/or logical entity that can store data. A data store may be, for example, a database, a table, a file, a list, a queue, a heap, and so on. A data store may reside in one logical and/or physical entity and/or may be distributed between two or more logical and/or physical entities.

Some portions of the detailed descriptions that follow are presented in terms of algorithms and symbolic representations of operations on data bits within a computer memory. These algorithmic descriptions and representations are the means used by those skilled in the data processing arts to convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated.

It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the following discussions, it is appreciated that throughout the description, discussions utilizing terms like processing, computing, calculating, determining, displaying, or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Flexible Sequences and Functionally Equivalent Circuits

It will be appreciated that some or all of the methods described herein involve electronic and/or software applications that may be dynamic and flexible processes so that they may be performed in sequences different than those described herein. It will also be appreciated by one of ordinary skill in the art that elements embodied as software may be implemented using various programming approaches such as machine language, procedural, object oriented, and/or artificial intelligence techniques.

The processing, analyses, and/or other functions described herein may also be implemented by functionally equivalent circuits like a digital signal processor (DSP), a software controlled microprocessor, or an ASIC. Components implemented as software are not limited to any particular programming language. Rather, the description provides the information one skilled in the art may use to fabricate circuits or to generate computer software and/or computer components to perform the processing of the system. It will be appreciated that some or all of the functions and/or behaviors of the example systems and methods may be implemented as logic as defined above.

DETAILED DESCRIPTION

The example systems and methods described herein concern processing IR signals, alone and/or in combination with other signals like visual image data, pressure sensing data, sound sensing data, and so on. In one example, the systems and methods operate on an IR signal, examining the thermal signature of one or more items in a field of view, comparing them with user specifiable parameters concerning thermal signatures, and determining whether the field of view contains an item within thermal alarm limits. If so, an alarm may be generated. The thermal signature may be based, for example, on the difference of the thermal intensity of an object compared to the background thermal intensity in a field of view.

Figure 1:
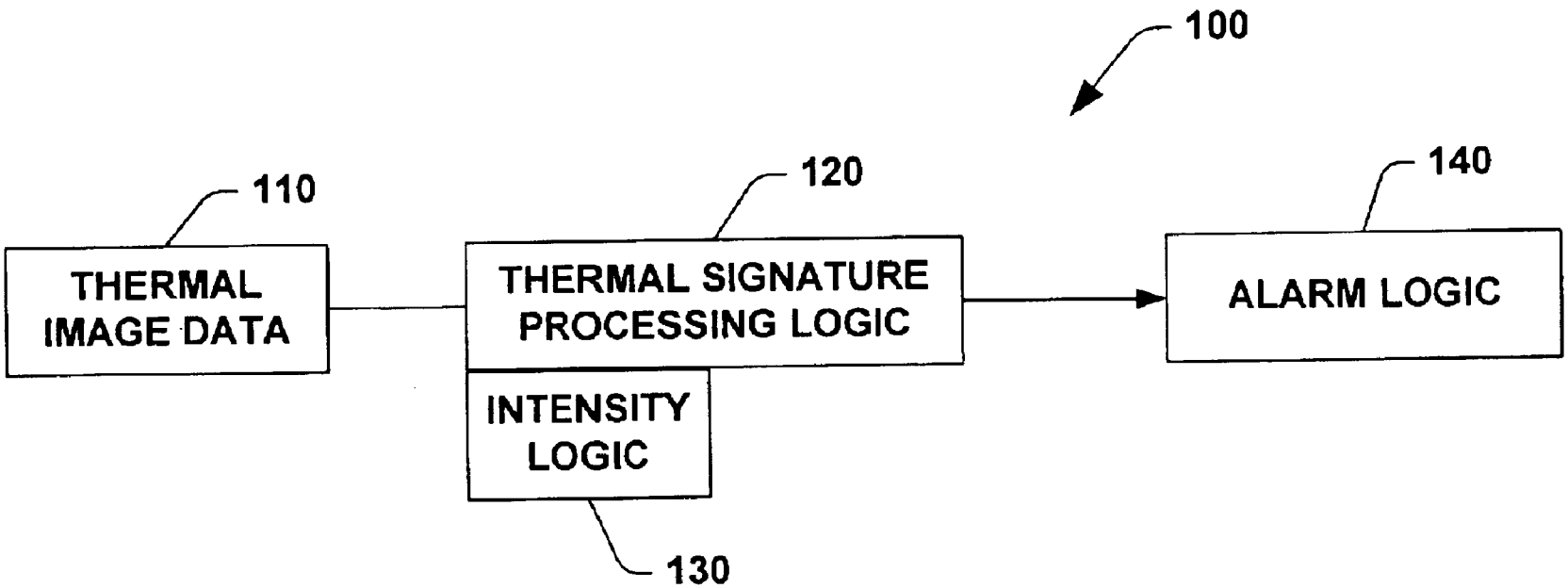
FIG. 1 illustrates an example thermal signature intensity alarming system.

Thus, FIG. 1 illustrates an example thermal signature intensity alarming system 100. The system 100 includes a thermal signature processing logic 120 that receives a thermal image data 110. The thermal image data 110 may come, for example, from an infrared (IR) camera. The thermal signature processing logic 120 processes the thermal image data 110 to identify an object of interest via its thermal signature. The system 100 may also include an intensity logic 130 that determines the relative intensity of the object of interest. For example, the background of a field of view may have a first thermal intensity. One or more objects in the field of view may have thermal signature intensities different from the first thermal intensity. If the thermal signature intensity differs from the background intensity and falls within a pre-determined, configurable range of intensities, then the system 100 may identify the object as being an object of interest. Then, alarm logic 140 may examine potential objects of interest and subject them to comparisons with various other pre-determined, configurable attributes to determine whether an alarm signal should be generated. Thus the system 100 includes an alarm logic 140 that determines whether an alarm-worthy event has occurred based on the thermal signature processing logic 120 analysis of the thermal image data 110 and/or the intensity logic 130 analysis of the relative thermal intensity of the object of interest.

One output from the example thermal signature target recognition system is an alarm. The alarm may be based on a probability function for identifying a given target. For example, the system may produce a determination that there is an x% likelihood that the target is one for which an alarm should be generated. By way of illustration, the system may generate an output that it is 75% likelihood that the item for which a thermal signature was detected is a human and a 10% likelihood that the item is a small animal.

In one example, the alarm logic 140 determines whether an alarm-worthy event has occurred based on values produced by the thermal signature processing logic 120 and/or the intensity logic 130 where the values are produced by processing the value of an individual pixel or a set of pixels. The following examples illustrate single pixel processing as compared to average effect processing. A region thermal threshold may be examined to determine whether an object changed the average thermal signature in the image enough to raise an alarm. For example, a human who is a mile from an example system may register as a single pixel in an image. Although the single pixel may be within the object thermal threshold (e.g., z% thermal intensity difference), the overall effect on the average thermal signature of the image may be too small to warrant an alarm. In this way, large warm objects that are beyond a desired range of interest (e.g., not within 50 yards of the sensor) can be ignored and not produce false alarms. Similarly, a small rodent (e.g., rat) inside the range of interest may be detected. Its thermal image may place it within the object thermal threshold (e.g., z% thermal intensity difference), and, it may affect more than one pixel, but again, its overall effect on the average thermal signature of the image may be too small to warrant an alarm. In this way, small warm objects that are within the desired range of interest may also be ignored and not produce false alarms.

Thus, in another example, the system 100 has alarm logic 140 determine whether an alarm-worthy event has occurred based on values produced by the thermal signature processing logic 120 and/or the intensity logic 130 where the values are produced by processing the effect an individual pixel or set of pixels has on an average value for a region of interest.

The system 100 may be implemented, in some examples, in computer components. Thus, portions of the system 100 may be distributed on a computer readable medium storing computer executable components of the system 100. While the system 100 is illustrated with three separate logics, it is to be appreciated that the processing performed by the logics can be implemented in a greater and/or lesser number of logics, and/or in a greater and/or lesser number of computer components.

Figure 2:
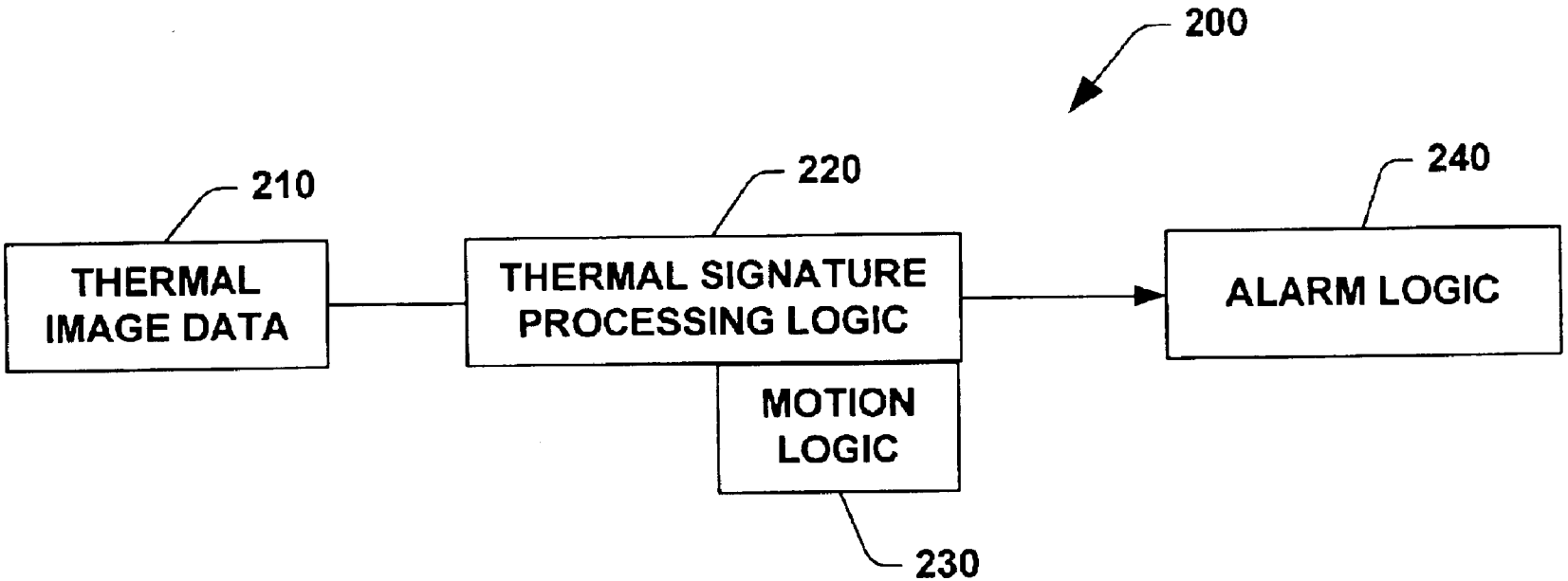
FIG. 2 illustrates an example thermal signature motion alarming system.

FIG. 2 illustrates an example thermal signature motion alarming system 200. The system 200 includes a thermal signature processing logic 220 that receives a thermal image data 210. The thermal image data 210 may come, for example, from an infrared (IR) camera. The thermal signature processing logic 220 processes the thermal image data 210 to identify an object of interest via its thermal signature. The system 200 may also include a motion logic 230 that determines whether the object of interest has moved. For example, the object of interest may appear in a first image at a first location. The object of interest may then appear in a second image at a second location. If the locations differ to within a pre-determined, configurable range of values, then the system 200 may identify the object as being an object of interest that has moved. Then, alarm logic 240 may examine potential objects of interest and subject them to comparisons with various other pre-determined, configurable attributes to determine whether an alarm signal should be generated. Thus the system 200 includes an alarm logic 240 that determines whether an alarm-worthy event has occurred based on the thermal signature processing logic 220 analysis of the thermal image data 210 and/or the motion logic 230 analysis of the motion of the object of interest.

In one example, the alarm logic 240 determines whether an alarm-worthy event has occurred based on values produced by the thermal signature processing logic 220 and/or the motion logic 230 where the values are produced by processing the value of an individual pixel or a set of pixels. In another example, the system 200 has alarm logic 240 determine whether an alarm-worthy event has occurred based on values produced by the thermal signature processing logic 220 and/or the motion logic 230 where the values are produced by processing the effect an individual pixel or set of pixels has on an average value for a region of interest.

The system 200 may be implemented, in some examples, in computer components. Thus, portions of the system 200 may be distributed on a computer readable medium storing computer executable components of the system 200. While the system 200 is illustrated with three separate logics, it is to be appreciated that the processing performed by the logics can be implemented in a greater and/or lesser number of logics, and/or in a greater and/or lesser number of computer components.

Figure 3:
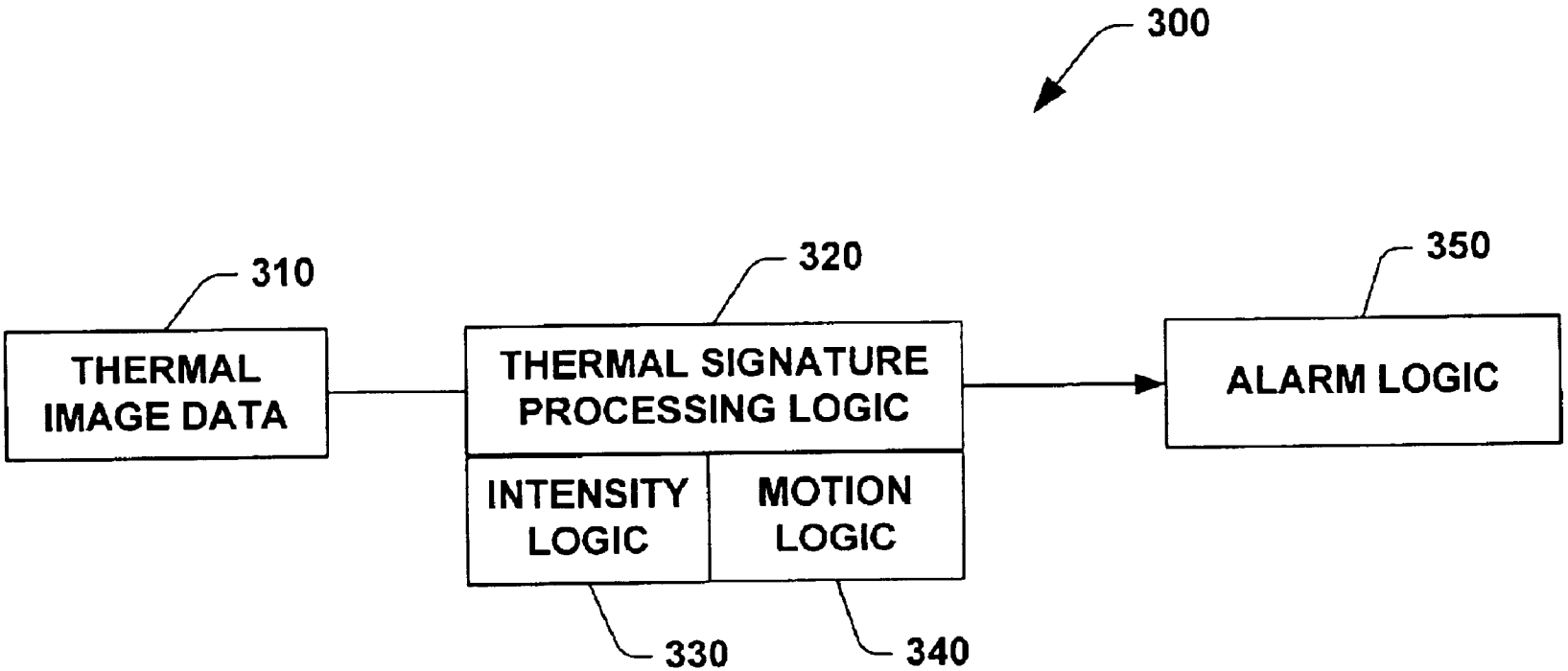
FIG. 3 illustrates an example combination thermal signature intensity and thermal signature motion alarming system.

FIG. 3 illustrates an example combination thermal signature intensity and thermal signature motion alarming system 300. The system 300 includes a thermal signature processing logic 320 that analyzes a thermal image data 310 to facilitate identifying an object of interest in a region of interest via its thermal signature. The system 300 also includes a motion logic 340 that facilitates determining the motion of the object of interest (e.g., whether it has moved). This determination can be made in a manner similar to that described above in conjunction with FIG. 2 via frame deltas.

The system 300 may also include an intensity logic 330 that facilitates determining the relative thermal signature intensity of the object of interest and an alarm logic 350. This determination can be made in a manner similar to that described above in conjunction with FIG. 1. The alarm logic 350 facilitates determining whether an alarm-worthy event has occurred based on the thermal signature processing logic 320 analysis of the thermal image data 310, the motion logic 340 analysis of the motion of the object of interest, and/or the intensity logic 330 analysis of the relative thermal intensity of the object of interest.

In one example, the alarm logic 350 determines whether an alarm-worthy event has occurred based on values produced by the thermal signature processing logic 320, the motion logic 340, and/or the intensity logic 330 where the values are produced by processing the value of an individual pixel or a set of pixels. In another example, the alarm logic 350 determines whether an alarm-worthy event has occurred based on values produced by the thermal signature processing logic 320, the motion logic 340, and/or the intensity logic 330, where the values are produced by processing the effect an individual pixel or set of pixels has on an average value for a region of interest.

The system 300 may be implemented, in some examples, in computer components. Thus, portions of the system 300 may be distributed on a computer readable medium storing computer executable components of the system 300. While the system 300 is illustrated with four separate logics, it is to be appreciated that the processing performed by the logics can be implemented in a greater and/or lesser number of logics, and/or in a greater and/or lesser number of computer components.

Some example systems and methods described herein may combine processing of visual and IR camera signals. This facilitates forming a composite image where items with an interesting thermal signature, and/or items with an interesting thermal signature that moved can be identified and presented to a user while visual imaging continues. This facilitates providing and/or enhancing both day and night surveillance in a field of view. The visual image data acquired by an optical camera can be combined through a mathematical function with thermal image data acquired by a thermal camera to produce a motsig data. The motsig data thus captures elements of both the visual image and the thermal image. By creating a composite visual and IR image, the visual daytime capability of a visual camera is enhanced. The composite visual and IR image can be created by overlaying relevant IR data over visual data. Relevant IR data can be data that is, for example, acquired from an object within user specifiable intensity thresholds.

To illustrate combination processing, a warm object (e.g., small rodent) may move across a region of interest in a field of view. Thermal signature processing can identify that an item within specified thermal intensity parameters is in the field of view. Then, visual frame difference analysis can determine that the item with the interesting thermal signature moved, its path, location, and so on. Thus, combination processing can determine whether to generate an alarm signal. For example, an object thermal threshold may be examined to determine whether an object is warm enough to be of interest without being too warm (e.g., x% warmer than the background in the field of view without being y% warmer).

By way of further illustration, an example system or method may determine, via visual processing, that something moved in a region of interest in the field of view. Rather than immediately generating an alarm signal condition and/or taking some other action (e.g., turning on a security light), the example system engages in additional thermal signature processing to determine not only that something moved, but also the heat signature of what moved and whether it is of interest to the system. It is to be appreciated that the additional thermal signature processing can be performed in serial and/or substantially in parallel with the visual processing. Additionally, and/or alternatively, an example system may determine, via thermal signature processing, that an object of potential interest is in a region of interest in the field of view. Then, additional visual processing may be employed to determine whether the object is actually of interest. For example, the outline of the object with the interesting thermal signature may be acquired using image processing. Then, target tracking, for example, may be applied to the detected and outlined object.

The combination processing can also facilitate producing a true positive (e.g., real alarm) where a conventional system might not. For example, a large warm object (e.g., human intruder) may, in some cases, foil a motion detection system by moving very slowly across a field of view. Thus, a visual processor may not detect the very slowly moving object. However, a visual processor working together with a thermal signature processor may detect this stealthy intruder due, for example, to the change in the overall thermal signature in the region of interest in the field of view. Similarly, a human who masks their heat signature may, in some cases, foil a detection system based solely on thermal signature processing. Thus, a thermal signature processor, working together with a visual processor may detect this intruder and properly raise an alarm.

It is to be appreciated that the thermal signature processing and the visual processing can occur individually, substantially in parallel, and/or serially, with either the thermal or visual processing going first and selectively triggering complimentary combination processing. Furthermore, the weight accorded to each type of processing can be adjusted based, for example, on operator settings and/or detected environmental factors. For example, in a first set of atmospheric conditions (e.g., windless 100 degree day), more weight may be accorded to visual analysis than thermal signature analysis when determining whether to raise an alarm while in a second set of atmospheric conditions (e.g., windy 24 degree day), more weight may be accorded to thermal signature analysis.

Figure 4:
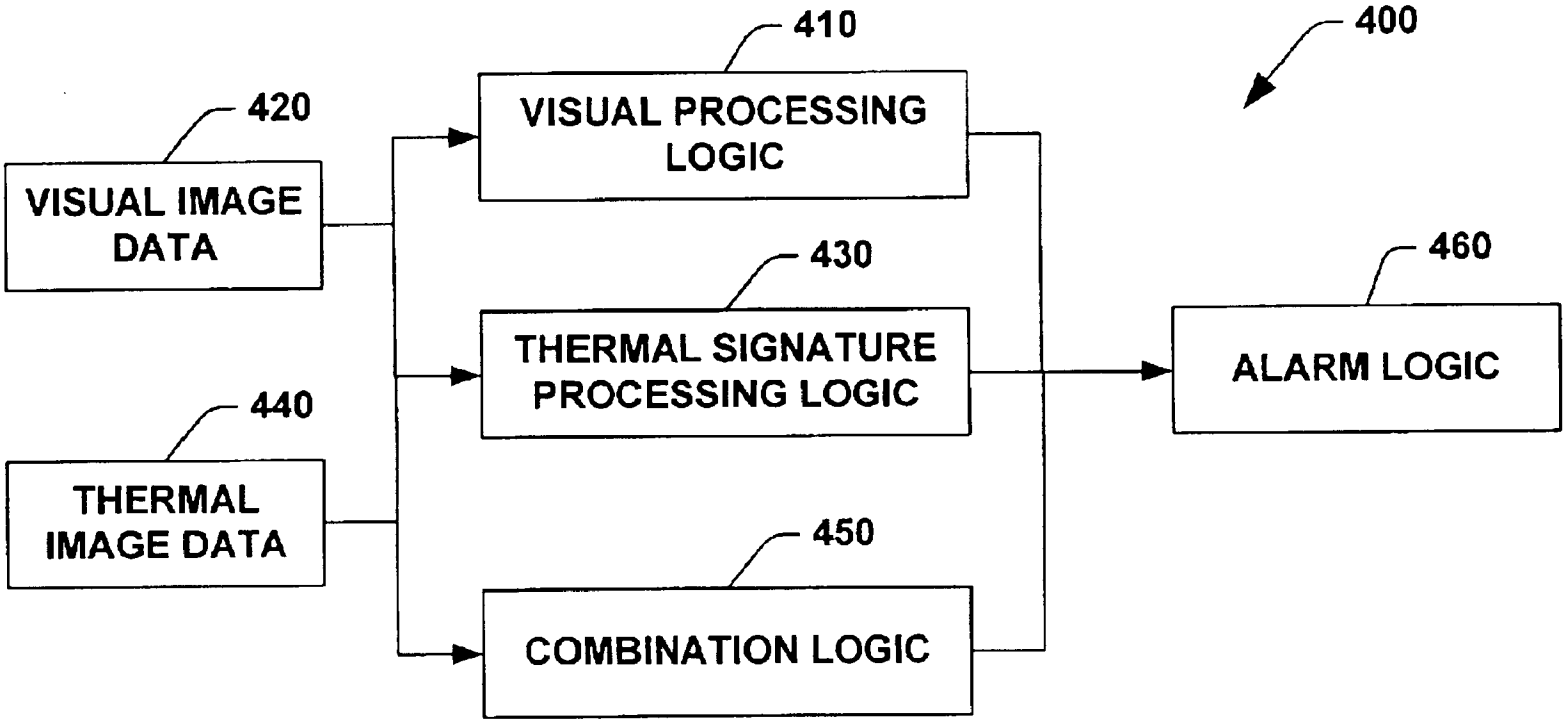
FIG. 4 illustrates an example thermal signature intensity and visual image alarming system.

Thus, FIG. 4 illustrates an example thermal signature intensity and visual image alarming system 400. The system 400 includes a visual processing logic 410 that analyzes a visual image data 420. For example, processing like edge detection, sshape detection, and so on may occur. The system 400 also includes a thermal signature processing logic 430 that analyzes a thermal image data 440 in manners analogous to those described above. The system 400 also includes a combination logic 450 that analyzes a combination of the visual image data 420 and the thermal image data 440. In one example, the combination logic 450 determines one or more relationships between one or more objects in the visual image data 420 and the thermal image data 440.

The system 400 also includes an alarm logic 460 for determining whether an alarm-worthy event has occurred based on one or more of the visual processing logic 410 analysis of the visual image data 420, the thermal signature processing logic 430 analysis of the thermal image data 440 and the combination logic 450 analysis of the combination of the visual image data 420 and the thermal image data 440 or relationships between objects in them.

In one example, the visual processing logic 410 is operably connected to a frame capturer that captures between 10 and 60 frames per second. The frame capturer may be, for example, a PCI frame grabber. While a PCI frame grabber is described, it is to be appreciated that other types of frame grabbers (e.g., USB) can be employed. Similarly, while 10 to 60 frames per second are described, it is to be appreciated that other rangers can be employed. The visual image data 420 may be acquired from a single frame and/or from two or more frames. The PCI frame grabber may sample data at a resolution of between 128×128 pixels and 1024×1024 pixels with a color depth of between 4 and 16 bits per pixel. While 128×128 to 1024×1024 pixels are described, it is to be appreciated that other ranges can be employed.

In one example, the visual processing logic 410 includes a visual image data transforming logic. The visual image transforming logic may perform actions including, but not limited to, blurring, sharpening, and filtering the visual image data 420.

The alarm logic 460 may determine whether an alarm-worthy event has occurred by evaluating the value of one or more pixels in the visual image data 420 or the thermal image data 440 on an individual basis. Additionally and/or alternatively, the alarm logic 460 may determine whether an alarm-worthy event has occurred by evaluating values of a set of pixels in the visual image data 420 or the thermal image data 440 on an averaged basis. In another example, the alarm logic 460 determines whether an alarm-worthy event has occurred by comparing a motsig data to a predetermined, configurable range for the motsig data.

The system 400 may be implemented, in some examples, in computer components. Thus, portions of the system 400 may be distributed on a computer readable medium storing computer executable components of the system 400. While the system 400 is illustrated with four separate logics, it is to be appreciated that the processing performed by the logics can be implemented in a greater and/or lesser number of logics, and/or in a greater and/or lesser number of computer components.

The system 400 can be employed to implement an intrusion detector. In one example, an infrared and visual intrusion detector includes an intruder infrared (IIR) module and a computer component on which associated application software will run. The infrared and visual intrusion detector may then be operably connected to other components including, but not limited to, a pan and tilt system that facilitates acquiring image and/or thermal data from a desired region of interest and a display system that facilitates displaying acquired and/or transformed image and/or thermal data.

Similarly, an IIR module and computer components for running associated application software may cooperate to produce a display. The display may be presented, for example, on a computer monitor and/or on a television. Thus, the IIR module and computer components for running associated application software may be operably connected by, for example, a National Television System Committee (NTSC) connection to a television. Similarly, the IIR module and computer components for running associated software may be connected to, for example, a computer monitor. The computer monitor and the television may display substantially similar images at substantially the same time but with different resolutions and image size, for example.

In one example, an IIR module has two logical processes. One process manages matters including, but not limited to, image acquisition, processing, and distribution while a second process facilitates actions including, but not limited to, commanding and controlling the IIR module and interfacing with a pan and tilt unit that houses an optical and/or thermal (e.g., IR) camera from which the images are acquired. While an infrared image acquisition is described, it is to be appreciated that other forms of thermal imagery can be employed.

In one example, image processing can include various logical activities. Although four activities are described, it is to be appreciated that a greater and/or lesser number of activities can be employed. Furthermore, while the activities are described sequentially, it is to be appreciated that the activities can be performed substantially in parallel.

One activity concerns frame capturing. In one example, image data may be acquired at approximately 30 frames per second (FPS) using a PCI frame grabber. Data may be sampled at a resolution of 320×240 pixels with a color depth of 8 bits per pixel (BPP). While approximately 30 FPS are described, it is to be appreciated that a greater and/or lesser number of FPS can be employed. Similarly, while a resolution of 320×240 is described, varying resolutions (e.g., 1024×1024) can be employed. Furthermore, while a color depth of 8 BPP is described, it is to be appreciated that different color depths can be used. Further still, while a PCI frame grabber is described, other frame grabbers (e.g., USB) can be employed.

Another activity concerns image transformation. Image transformation can include, but is not limited to, blurring image data, sharpening image data, and filtering image data through, for example, low pass, high pass, and/or bandpass filters. Image transformation can also include performing edge detection operations. In one example, for efficiency, transformations are processed in a spatial domain using 3×3 kernels, although other kernel sizes may be employed.

Another activity concerns alarm testing. Alarm testing can concern, for example, a combination of three parameters. One parameter, the mode parameter, facilitates determining whether data to be evaluated is taken from a single frame, distinct frames, and/or differences between frames (frame deltas). Another parameter, the evaluation mechanism parameter, facilitates determining whether an alarm will be triggered based on pixel data from, for example, an individual pixel, a set of pixels, and/or an average pixel value from a region of interest. Another parameter, value range, facilitates establishing and/or maintaining boundaries for an alarm range. For example, in a mammal intrusion system, a temperature value range may be established to facilitate generating alarms only for items with a thermal intensity greater than a lower threshold and/or less than an upper threshold. In an industrial pollutant intrusion system where certain toxic chemical byproducts may be produced, a thermal intensity range may be established that corresponds to a relative difference of approximately 100 degrees Celsius. Similarly, in a missile intrusion system programmed to detect re-entering ballistic missiles, the thermal intensity range may be established to correspond to a relative difference of approximately 1,000 degrees Celsius. In combination systems, an associated tracking velocity and/or motion displacement may also be established. For example, parameters can be established and/or manipulated to account for a branch gently swaying back and forth in a breeze with a warm bird perched on the branch. Though there is motion, and a thermal signature, this is not the type of event for which an alarm signal is desired. Thus, so long as the velocity of the warm object remains within a certain range and so long as the distance moved by the object remains below a certain threshold, no alarm signal will be generated.

The alarm testing may be applied to one or more arbitrary regions of interest (ROI). An ROI may have its own alarm parameters.

Another activity concerns image distribution. Image data may be colorized according to a pre-determined, configurable palette and distributed to display components like a computer monitor and/or television. Upon the occurrence of actions including, but not limited to, an alarm and a request from an associated application, image data may be stored in a data store and/or on a recordable medium. For example, an image may be sent to disk and/or videotape. Since the image data may traverse a computer network in a computer communication, the image data may be compressed using, for example, a Coarse Sampling and Quantization (CSQ) method. It is to be appreciated that other compression techniques may be employed.

Various application software can be associated with the systems and methods described herein. For example, application software including, but not limited to, software that facilitates controlling visual and/or thermal imagers, controlling a pan/tilt unit, controlling imaging, and controlling alarming can be associated with the example systems and methods.

An example image controller software facilitates, for example, adjusting imager focus, adjusting imager field of view, establishing and/or adjusting automatic settings, establishing and/or adjusting manual settings, adjusting gain, adjusting filter levels, adjusting polarity, adjusting zoom, and so on. Information associated with image controlling may be presented, for example, via a graphical user interface using a variety of graphical user interface (GUI) elements (e.g., graphs, dials, gauges, sliders, buttons) in a variety of formats (e.g., digital, analog). Some example GUI elements are illustrated in FIGS. 19 through 22.

An example pan/tilt controller application facilitates manually and/or automatically panning and/or tilting a unit on which an optical camera and/or a thermal camera are mounted. A pan/tilt controller may facilitate establishing parameters including, but not limited to, panning and/or tilting speeds, cycle rates, panning and/or tilting patterns, and so on. Information associated with pan/tilt control may be presented, for example, via a graphical user interface using a variety of graphical user interface elements in a variety of formats.

An example imaging control application facilitates establishing and/or maintaining parameters associated with transforming acquired data. For example, color palettes may be established and/or maintained to facilitate colorizing data. Again, information associated with imaging control applications can be presented through a GUI.

In view of the exemplary systems shown and described herein, example methodologies that are implemented will be better appreciated with reference to the flow diagrams of FIGS. 5 through 9. While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Furthermore, additional and/or alternative methodologies can employ additional, not illustrated blocks. In one example, methodologies are implemented as computer executable instructions and/or operations, stored on computer readable media including, but not limited to an application specific integrated circuit (ASIC), a compact disc (CD), a digital versatile disk (DVD), a random access memory (RAM), a read only memory (ROM), a programmable read only memory (PROM), an electronically erasable programmable read only memory (EEPROM), a disk, a carrier wave, and a memory stick.

In the flow diagrams, rectangular blocks denote "processing blocks" that may be implemented, for example, in software. Similarly, the diamond shaped blocks denote "decision blocks" or "flow control blocks" that may also be implemented, for example, in software. Alternatively, and/or additionally, the processing and decision blocks can be implemented in functionally equivalent circuits like a digital signal processor (DSP), an ASIC, and the like.

A flow diagram does not depict syntax for any particular programming language, methodology, or style (e.g., procedural, object-oriented). Rather, a flow diagram illustrates functional information one skilled in the art may employ to program software, design circuits, and so on. It is to be appreciated that in some examples, program elements like temporary variables, initialization of loops and variables, routine loops, and so on are not shown. Furthermore, while some steps are shown occurring serially, it is to be appreciated that some illustrated steps may occur substantially in parallel.

Figure 5:
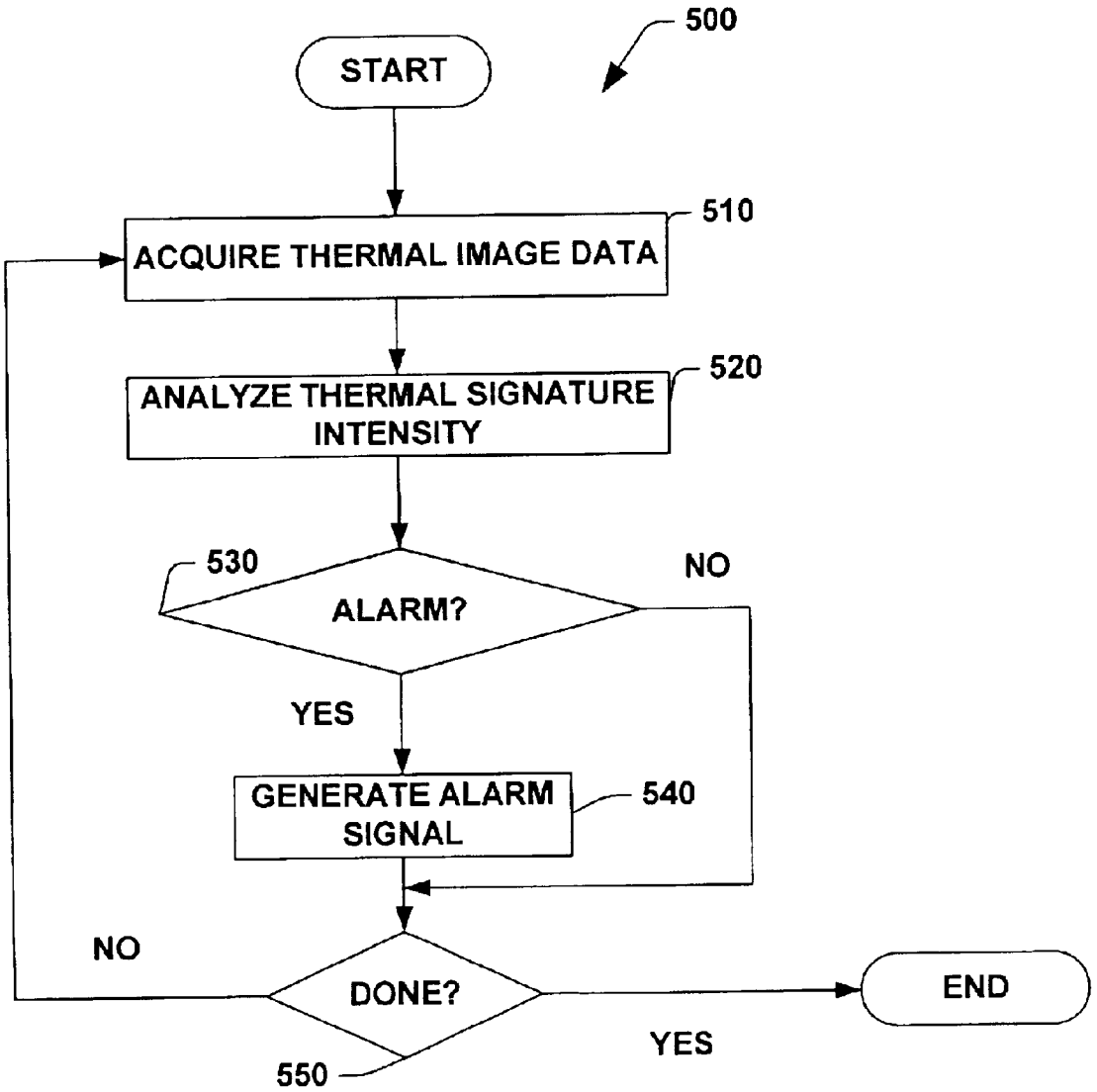
FIG. 5 illustrates an example method for thermal signature intensity alarming.

FIG. 5 illustrates an example method 500 for thermal signature intensity alarming. The method 500 includes, at 510 acquiring a thermal image data. The thermal image data may be acquired, for example, from an IR camera. The method 500 also includes, at 520, analyzing the thermal image data to identify a thermal signature intensity for an object of interest in a region of interest. The analysis may include, for example, identifying regions where thermal intensity values change (e.g., gradients). Identifying locations where changes occur can facilitate, for example, determining the size, shape, location, and so on of an object. With the data acquired and analyzed, the method 500 includes, at 530 determining whether an alarm signal should be generated based on the thermal signature intensity of the object of interest. If the determination at 530 is YES, then at 540 an alarm is selectively raised. Otherwise, processing proceeds to 550. At 550, a determination is made concerning whether to continue the method 500 or to exit. The method 500 may be implemented as a computer program and thus may be distributed on a computer readable medium holding computer executable instructions.

Figure 6:
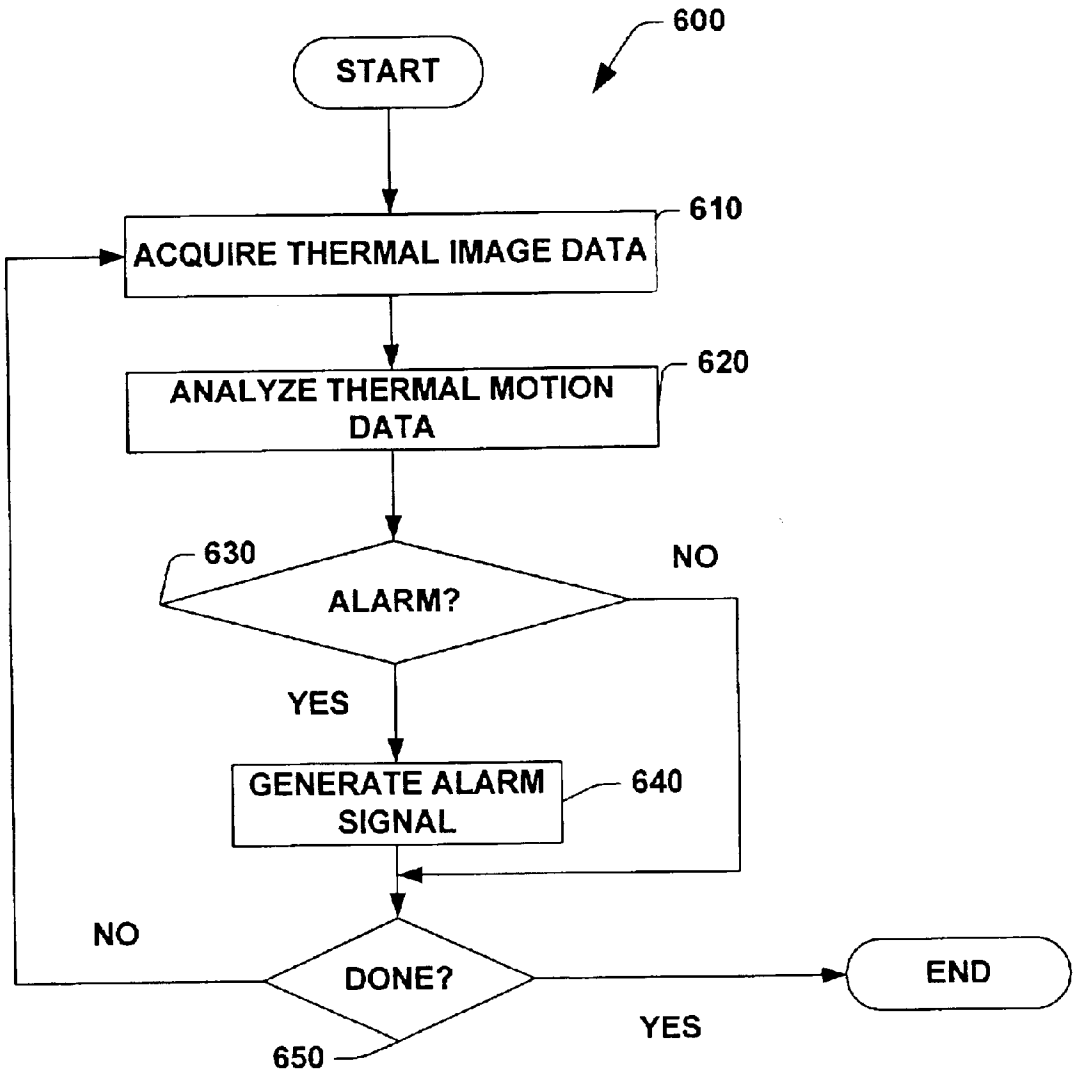
FIG. 6 illustrates an example method for thermal signature motion alarming.

FIG. 6 illustrates an example method 600 for thermal signature motion alarming. The method 600 includes, at 610 acquiring a thermal image data. The thermal image data may be acquired, for example, from an IR camera. The method 600 includes, at 620, analyzing the thermal image data to identify a motion for an object of interest in a region of interest. The analysis can be performed by, for example, frame deltas (e.g., comparing a first frame with a second frame and identifying differences). The method 600 also includes, at 630, determining whether an alarm signal should be generated based on the motion of the object of interest. If the determination at 630 is yes, then at 640 an alarm signal is selectively generated. For example, a data packet may be generated and/or transmitted, an interrupt line may be manipulated, a data line may be manipulated, a sound may be generated, a visual indicator may be generated, and so on. At 650, a determination is made concerning whether to continue processing. The method 600 may be implemented as a computer program and thus may be distributed on a computer readable medium holding computer executable instructions.

Figure 7:
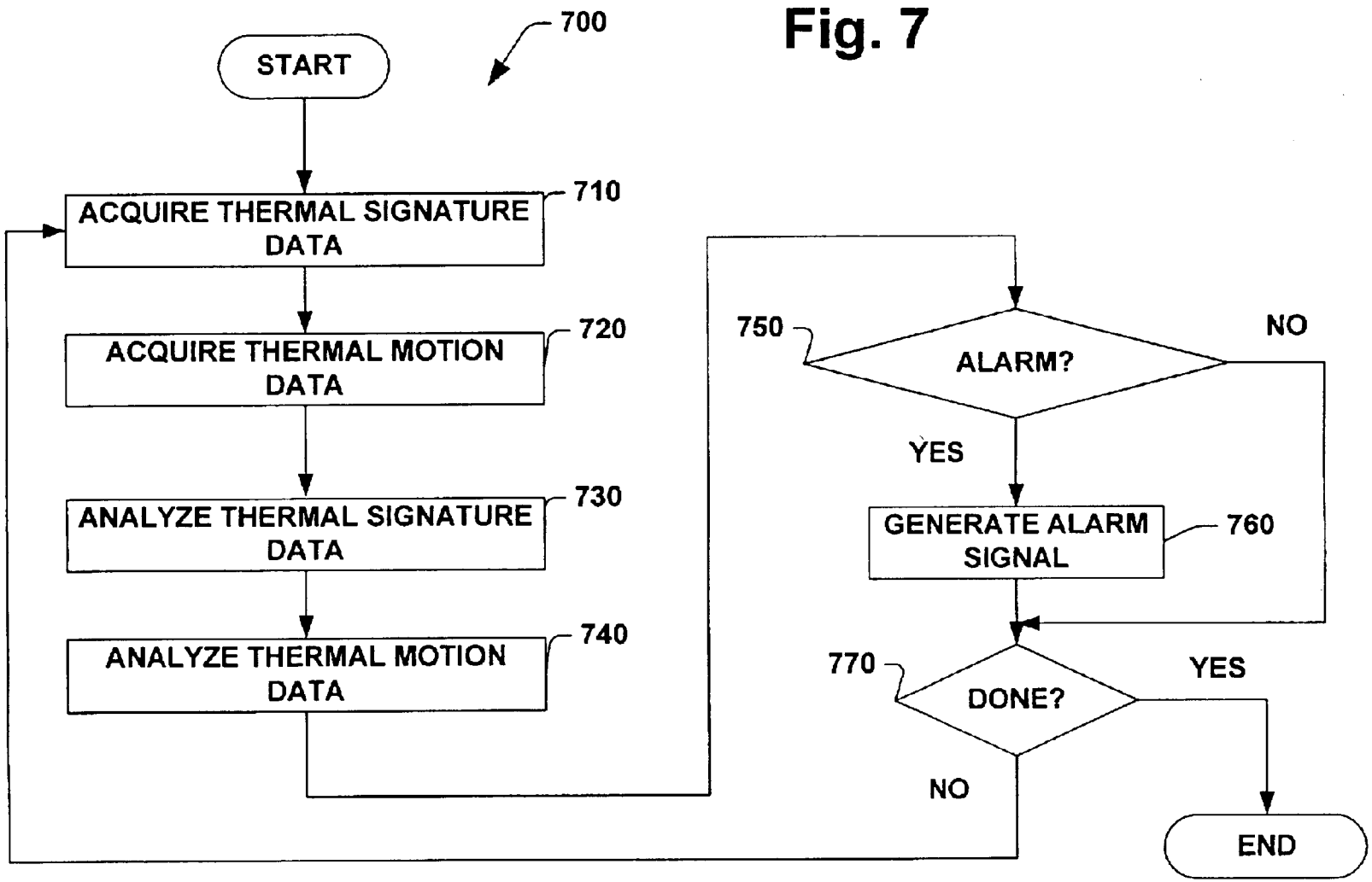
FIG. 7 illustrates an example method for combined thermal signature intensity and thermal signature motion alarming.

FIG. 7 illustrates an example method 700 for combined thermal signature intensity and thermal signature motion alarming. The method 700 includes acquiring a thermal signature data. The data may be acquired, for example, from an IR camera. The method 700 also includes, at 720, acquiring a thermal motion data. While two actions, acquiring thermal signature data and acquiring thermal motion data, are illustrated, it is to be appreciated that the thermal signature data and the thermal motion data may both reside in a thermal image data.

The method 700 includes, at 730, analyzing the thermal data (e.g., signature, motion, image) to identify a thermal signature intensity for an object of interest in a region of interest. The thermal signature intensity may be determined, for example, by identifying and relatively quantifying temperature differentials. The method 700 also includes, at 740, analyzing the thermal data to identify a motion for the object of interest in a region of interest. For example, frame deltas may be examined where the center of mass of the thermal signature of an object is examined. At 750, a determination is made concerning whether an alarm signal should be generated based on the motion of the object of interest and/or the thermal signature intensity of the object of interest. If the determination at 750 is YES, then at 760 an alarm is selectively generated. At 770, a determination is made concerning whether to continue processing. If so, processing returns to 710, otherwise processing can conclude. The method 700 may be implemented as a computer program and thus may be distributed on a computer readable medium holding computer executable instructions.

Figure 8:
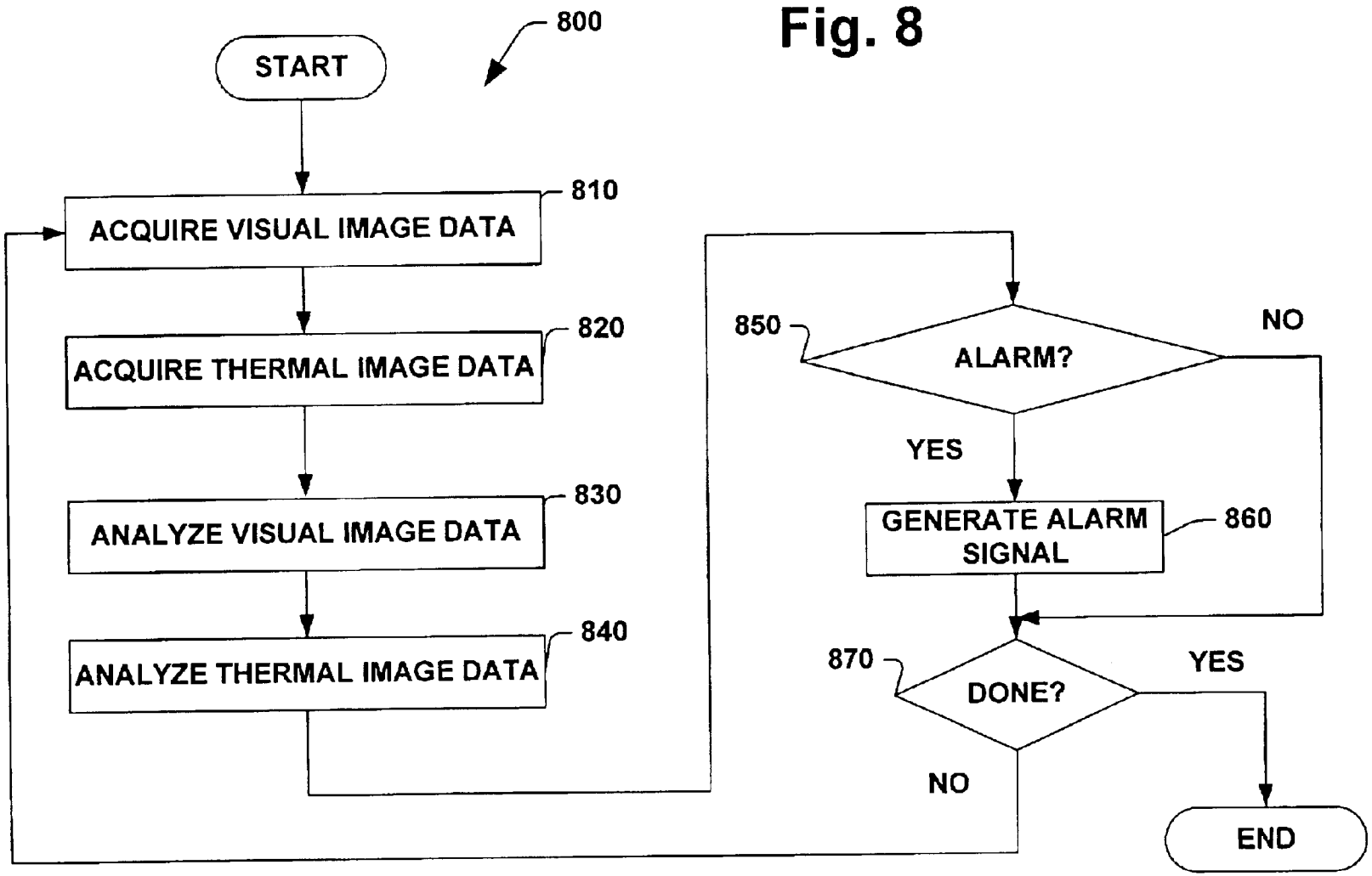
FIG. 8 illustrates an example method for combined thermal signature intensity and visual image processing alarming.

FIG. 8 illustrates an example method 800 for combined thermal signature intensity and visual image processing alarming. Example intrusion detecting systems and methods described herein may combine visual processing (e.g., frame analysis) with thermal signature processing (e.g., IR analysis). An example method may determine, via visual processing, that something moved in a region of interest in a field of view. However, rather than immediately generating an alarm signal and/or taking some other action (e.g., turning on a security light), the example method engages in additional thermal signature processing to determine not only that something moved, but what moved and whether it is of interest. The visual processing may be performed before the thermal signature processing, after the thermal signature processing and/or substantially in parallel with the thermal signature processing. Furthermore, visual data may be analyzed in relation to corresponding thermal data.

By way of illustration, a candy bar wrapper may blow across a region of interest in a field of view in a motion detection system. A frame difference processor may determine that motion occurred. A thermal signature processor may determine that the object was cold, and thus should be ignored. Thus, the visual data (e.g., frame deltas) is analyzed in relation to the thermal image data (e.g., heat signature acquired via IR) to determine that although motion occurred in a region of interest to the system, the motion was not an intrusion by an object of interest and thus no alarm signal should be generated.

Thus, turning to FIG. 8, the method 800 includes, at 810, acquiring a visual image data. In one example, the visual image data is acquired from a frame grabber. The method 800 also includes, at 820, acquiring a thermal image data. In one example, the thermal image data is acquired from an infrared apparatus. The method 800 includes, at 830, analyzing the visual image data and also analyzing the thermal image data to determine whether an alarm-worthy event has occurred. For example, the analysis may determine whether an object with a thermal intensity signal that falls within a pre-determined configurable range has been detected, and if so, whether one or more visual attributes identify the object as being an object of interest. Thus, the method 800 includes, at 850, determining whether to generate an alarm signal (e.g., toggle an electrical line, generate a data packet, generate an interrupt, send an email, generate a sound, turn on a floodlight). If the determination at 850 is YES, then at 860 an alarm signal is selectively generated based on the analyzing of the visual image data and the thermal image data.

The visual image data acquired at 810 may be processed and displayed on a display (e.g., computer monitor, television screen). Various image improvement techniques can be applied to the data. Thus, the method 800 may also include transforming the visual image data by one or more of blurring, sharpening, and filtering.

Like the systems and methods described above, the method 800 may determine whether an alarm-worthy event has occurred based on the value of a single pixel and/or on the average value of a set of two or more pixels. Similarly, the method 800 may determine that an alarm-worthy event has occurred based on data from a single frame and/or on data from a set of two or more frames. The method 800 may be implemented as a computer program and thus may be distributed on a computer readable medium holding computer executable instructions.

Figure 9:
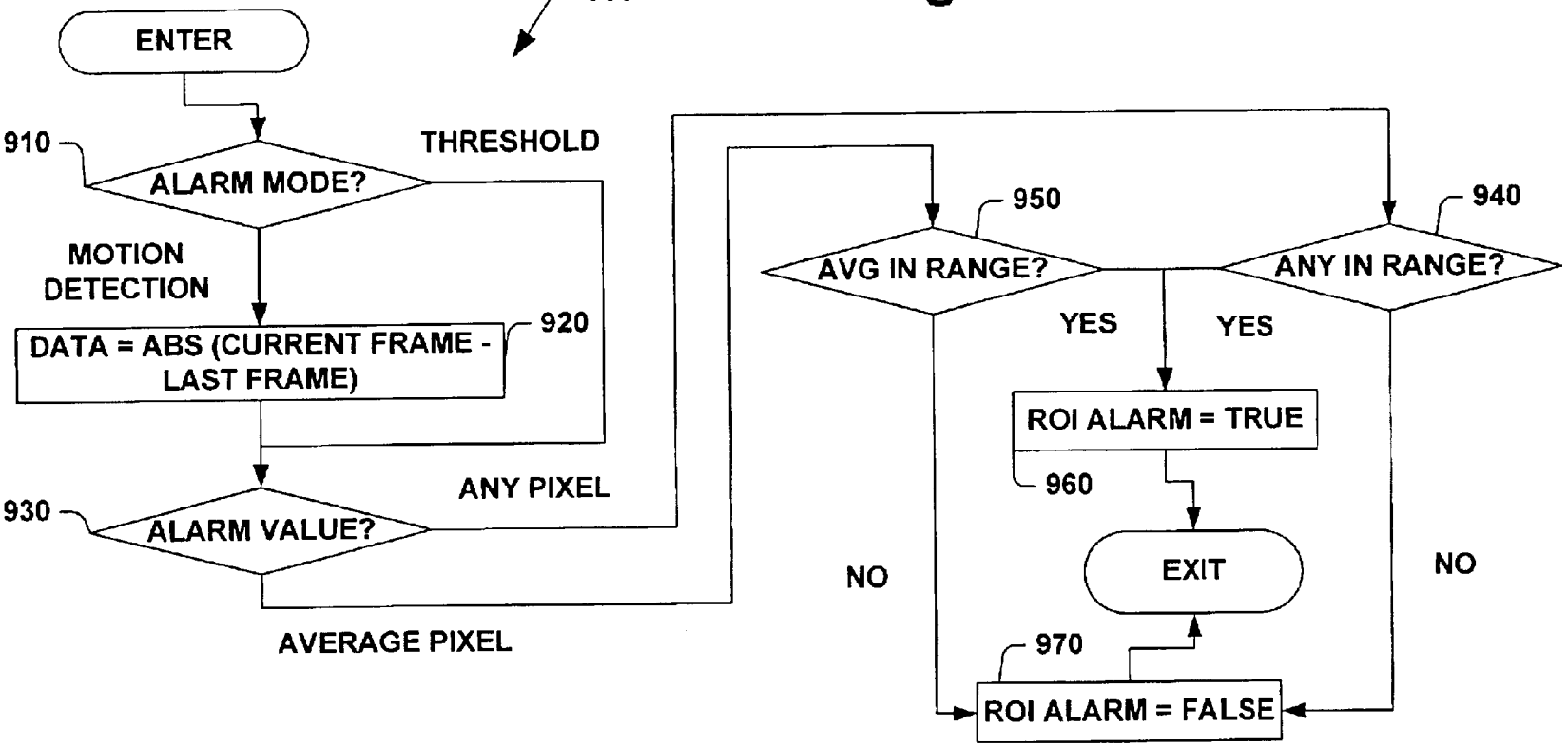
FIG. 9 illustrates an example alarm determining subroutine.

FIG. 9 illustrates an example alarm determining subroutine 900. At 910, a determination is made concerning what type of alarm mode is to be processed. If the determination at 910 is motion detection alarming, then at 920, a frame delta data is generated by comparing a current frame with a previous frame. This facilitates determining whether an object with a thermal signature intensity that falls within a predetermined, configurable range has moved. If the determination at 910 is thermal signal intensity thresholding, then processing continues at 930.

At 930, a determination is made concerning what type of alarm value processing is to occur. Alarm value processing types can include, but are not limited to, alarming based on the value of a single pixel, alarming based on the value of a set of pixels, alarming based on the effect of a heat signature on the overall average for a region of interest, and so on. Thus, if the determination at 930 is that alarming is based on any pixel processing, then processing continues at 940. If the determination at 930 is that alarming is based on average pixel values, then processing continues at 950.

At 940, a determination is made concerning whether any pixel in the region of interest has a thermal intensity signature within a predetermined, configurable range. For example, a pixel may have a thermal intensity signature greater than the background signature, but may not be sufficiently different to rise to the level of an item of interest. Similarly, at 950, a determination is made concerning whether the effect on the average value of pixels is within a pre-determined, configurable range. If either 940 or 950 evaluates to YES, then at 960, an alarm variable can be set to true. Conversely, if neither 940 nor 950 evaluates to YES, then at 970 the alarm variable can be set to false.

Figure 10:
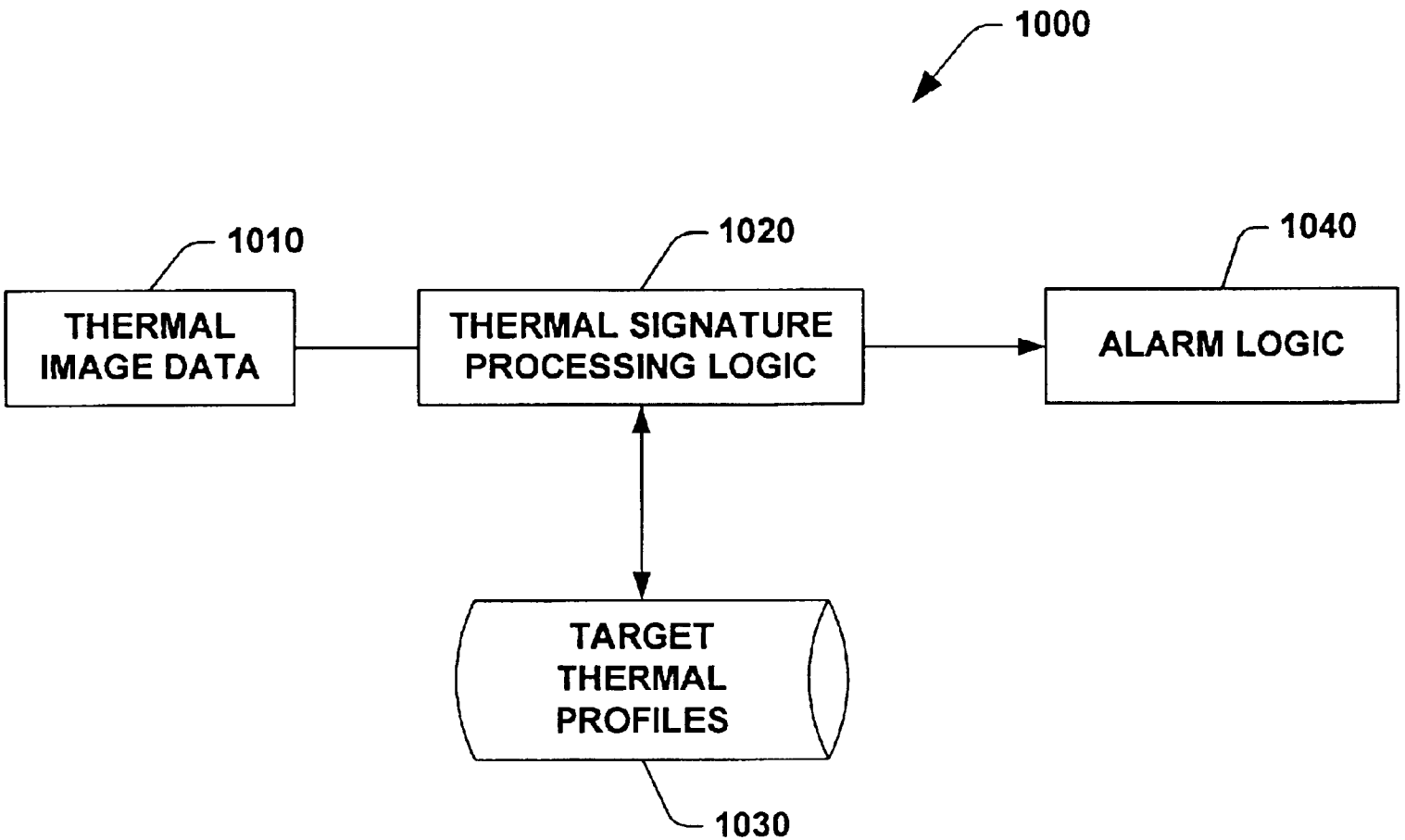
FIG. 10 illustrates an example thermal signature intensity identification system.

FIG. 10 illustrates an example thermal signature intensity identification system 1000. The system includes a thermal signature processing logic 1020 that receives and analyzes a thermal image data 1010. The thermal signature processing logic 1020 has access to a data store 1030 of target thermal profiles and is operably connected to an alarm logic 1040 that can generate an alarm signal. The thermal signature processing logic 1020 can perform processing like acquiring the thermal image data 1010, and analyzing the thermal image data 1010 to identify a thermal signature intensity for an object of interest in a region of interest. The thermal signature processing logic 1020 can also perform processing like accessing a data store 1030 of thermal signatures and generating a target identification based on comparing the thermal signature identified by the thermal signature processing logic 1020 to one or more of the thermal signatures in the data store 1030.

By way of illustration, the thermal image data 1010 may hold data that is resolved into two thermal intensity signatures by the logic 1020. A first signature may match a signature in the data store 1030, and that signature may be of an irrelevant item (e.g., rat). A second signature may match a signature in the data store 1030, and that signature may be of a relevant item (e.g., tank). Thus, the logic 1020 and the alarm logic 1040 may determine whether to raise an alarm based on the matching of the signatures. In some cases, the thermal intensity signature may not match any signature in the data store 1030. In this situation the logic 1020 may take actions like, ignoring the signature, storing the signature for more refined processing, bringing the signature to the attention of an operator, adding the signature to the data store 1030 and classifying it as "recognized, not identified", and so on.

The example systems and methods described herein thus facilitate thermal signature based target recognition. IR signals received from a field of view can be analyzed to determine whether a particular thermal signature has been detected. For example, while the visual signature of a first and second vehicle may be similar, the thermal signature may be different. Consider situations where a remote system is monitoring a bridge crossing. While visual processing may facilitate distinguishing cars from tanks during acceptable lighting conditions (e.g., day, not a snowstorm), IR processing may facilitate distinguishing tanks from cars in unacceptable lighting conditions (e.g., night, fog). When a thermal signature is detected, it may be compared to a set of stored thermal signatures to determine whether an alarm worthy item has been detected. The set of stored thermal signatures can be static and/or dynamic (e.g., trainable by programmed addition, trained by supervised learning).

Figure 11:
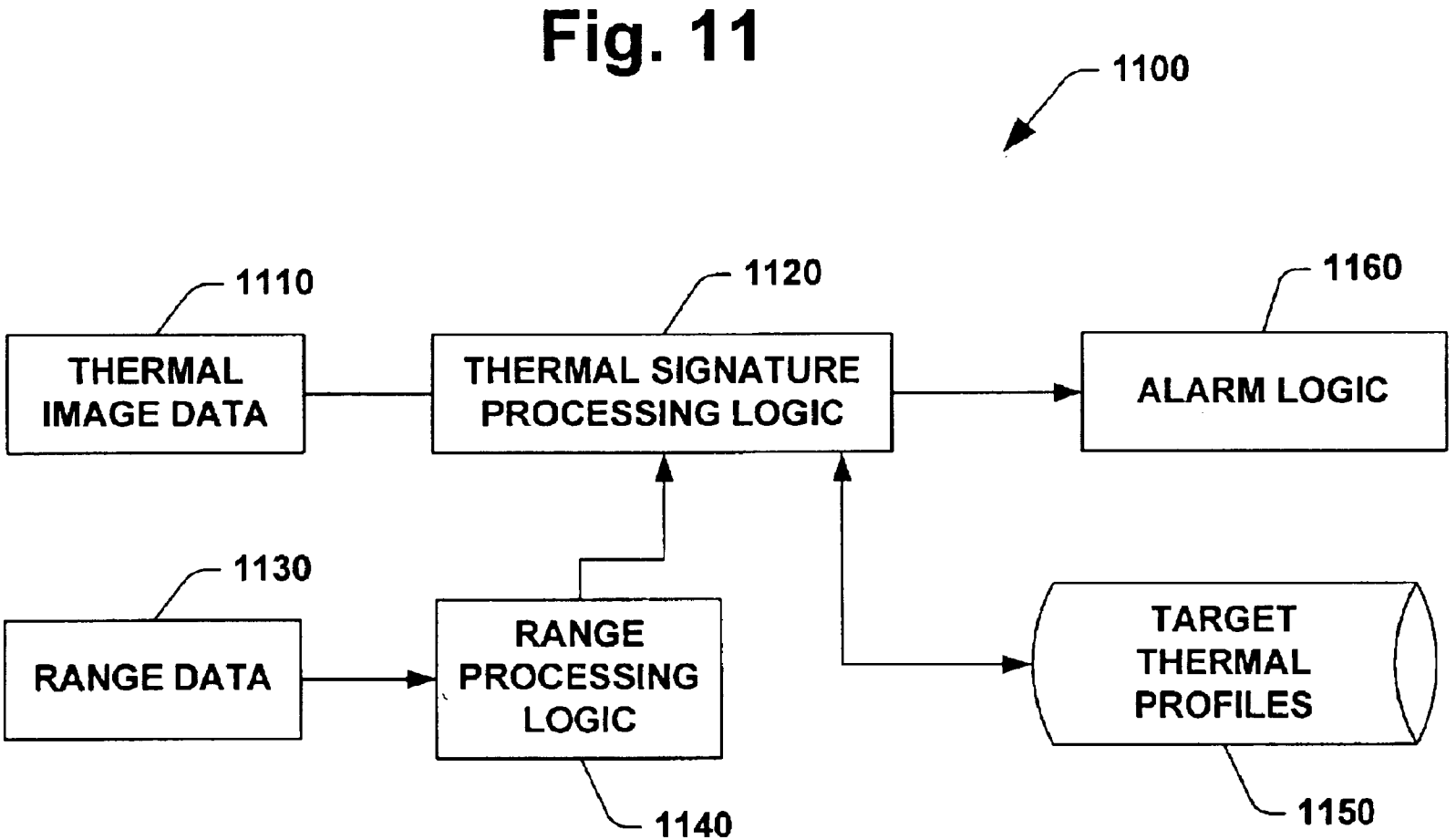
FIG. 11 illustrates an example thermal signature intensity identification system with associated range finding logic.

FIG. 11 illustrates an example thermal signature intensity identification system 1100 with associated range processing logic 1140. The system 1100 includes a thermal signature processing logic 1120 that receives and analyzes a thermal image data 1110. The system 1100 also includes alarm logic 1160 that can generate an alarm signal based on the thermal signature processing and/or data generated by the range processing logic 1140. The range processing logic 1140 receives a range data 1130 from, for example, a laser range finder mounted coaxially with the IR camera from which the thermal image data 1110 is gathered.

The range data 1130 and the range processing logic 1140 help the thermal signature processing logic 1120 determine whether thermal signatures match those stored in a data store 1150 of target thermal profiles. For example, while a soldier may have a first thermal signature at a first distance, the same soldier may have a second thermal signature at a second distance. Thus, deciding which thermal signatures in the data store 1150 to compare to a signature produced by the logic 1120 is facilitated by the range processing logic 1140. In one example, the range processing logic 1140 can be employed to assist automatically focusing a thermal image data device and/or a visual camera.

The example systems and methods described herein also facilitate automatically focusing a camera while tracking an object. For long range detection, lenses with long focal lengths are employed. However, lenses with long focal lengths may have a relatively small depth of field. Thus, lenses with long focal lengths may require frequent focusing to facilitate providing a viewer with an in-focus image during target tracking. Conventionally, focusing may have been based, for example, on laser range finding and other similar techniques. In one example of the systems and methods described herein, focusing is based on determinations made from examining the thermal gradient between a tracked target and the background. In one example, the focus is adjusted to maximize this gradient.

Thus, a target recognition system can be enhanced with range to target information, which may alter the probability determinations produced by the logics 1120 and/or 1160. Range to target information can be gathered, for example, from a laser range finder mounted co-axially with the thermal imager. While a laser range finder mounted co-axially is described, it is to be appreciated that range to target information may be gathered from other sources including, but not limited to, triangulation equipment, force plates, sound based systems, overhead satellite imagery systems, and so on.

Figure 12:
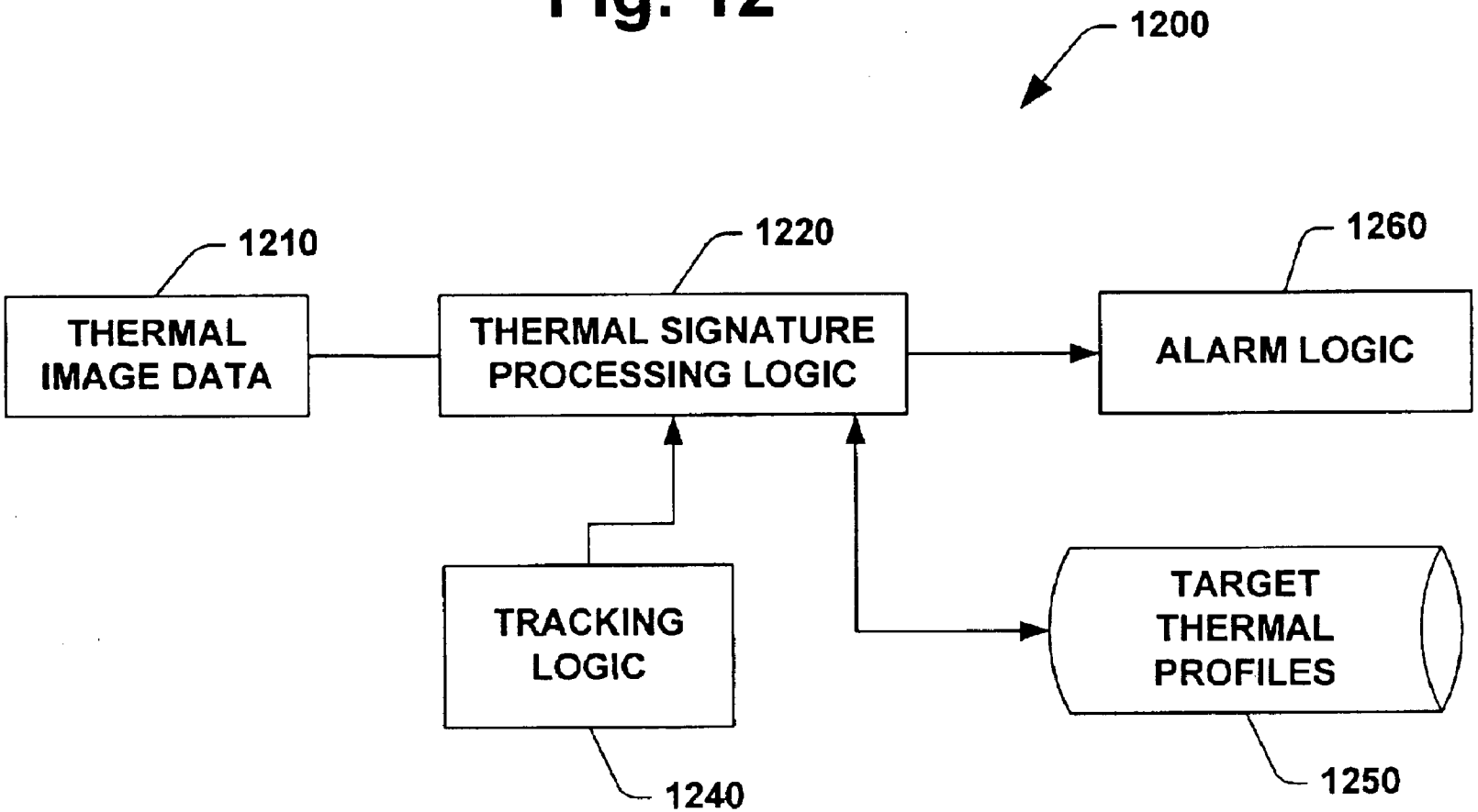
FIG. 12 illustrates an example thermal signature intensity processing system with associated tracking logic.

FIG. 12 illustrates an example thermal signature intensity processing system 1200 with associated tracking logic 1240. The system 1200 includes a thermal signature processing logic 1220 that receives and analyzes a thermal image data 1210. The logic 1220 facilitates identifying a thermal signature and potentially matching it with a signature stored in the data store 1250. Additionally, the logic 1240 can facilitate tracking an object of interest. Thus, the logic 1220 and the logic 1240 can perform processing like acquiring a thermal image data 1210 from a thermal image data device, analyzing the thermal image data 1210 to identify a thermal signature for an object of interest in a region of interest, and selectively controlling a thermal image data device to track the object of interest based on the thermal signature. Additionally, and/or alternatively, the logic 1240 and/or 1220 can selectively control a visual camera.

The example systems and methods described herein also facilitate thermal signature based target tracking. A thermal signature based target tracking system facilitates tracking objects identified by their thermal signature. Thus, targets within a pre-determined, configurable thermal intensity range can be tracked via IR, even if the target moves into an area where it might be lost by a conventional visual tracking system (e.g., camouflage area). The IR based target tracking can be initiated by methods like, a user designating a target to track, the system automatically designating a target to track based on its thermal signature, and so on. Additionally, the thermal signature based target tracking can be combined with visual target tracking. The combined processing facilitates enhancing day/night capability.

Figure 13:
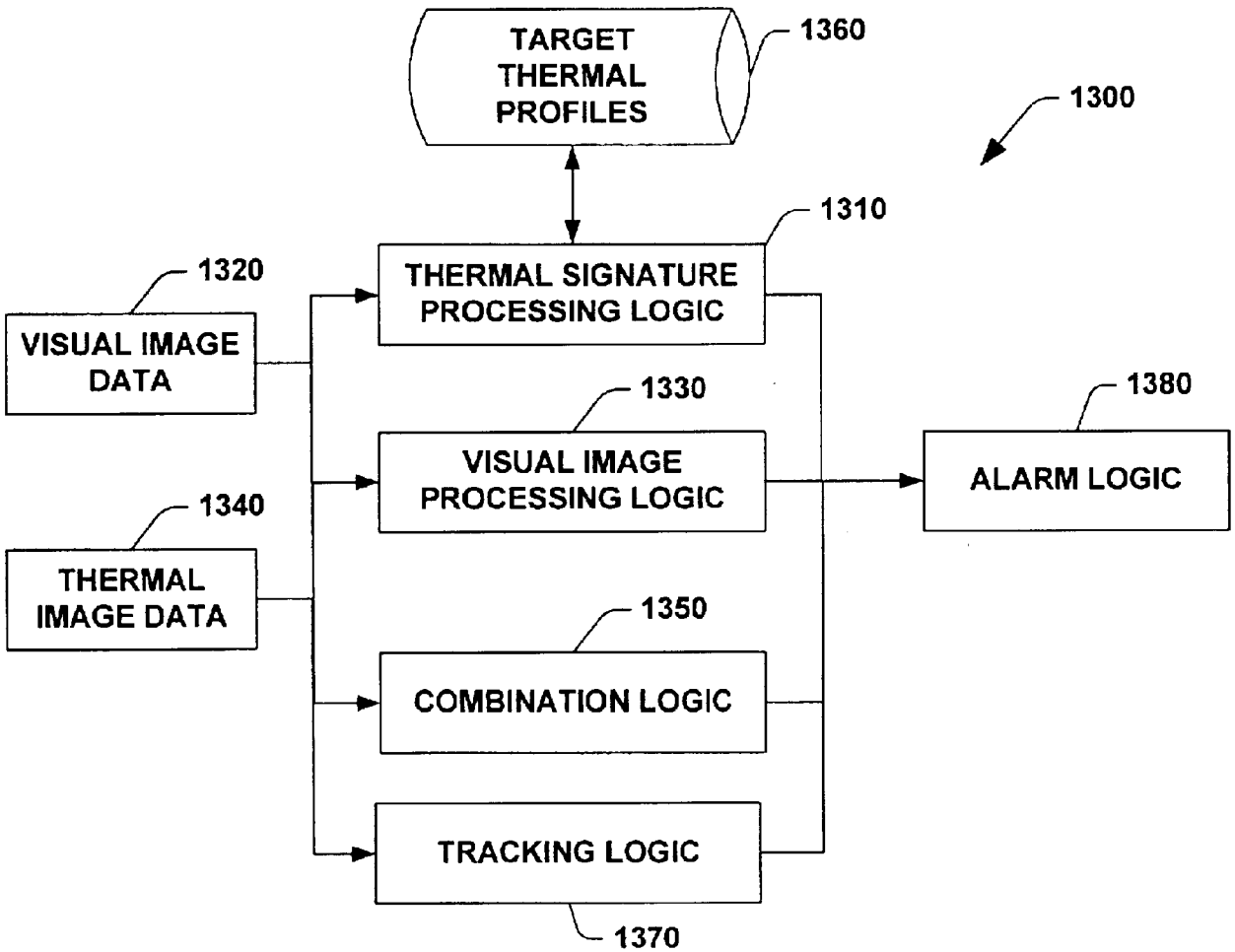
FIG. 13 illustrates an example combined thermal signature intensity and visual image processing system with associated tracking logic.

FIG. 13 illustrates an example combined thermal signature intensity and visual image processing system 1300 with associated tracking logic 1370. The system 1300 includes a thermal signature processing logic 1310 that acquires and analyzes a thermal image data 1340. The system 1300 also includes a visual image processing logic 1330 that acquires and processes a visual image data 1320. One way in which the visual image data 1320 can be processed is by generating a presentation of the visual image data 1320 where the presentation includes enhancing one or more objects whose thermal signature intensity is within a pre-determined, configurable range. Thus, the thermal signature processing logic 1310 may identify a thermal intensity signature and match it with one or more signatures stored in the data store 1360.

Then, combination logic 1350 may enhance the visual image produced by the logic 1330 by, for example, outlining the object with the matched thermal signature. Then, with the object highlighted, the tracking logic 1370 may facilitate a viewer tracking the object through the combination of visual and thermal data.

By way of illustration, IR cameras are typically employed for night vision with visual cameras employed for daytime vision. However, combining visual cameras with IR cameras enhances daytime visual imaging by facilitating bringing attention to (e.g., highlighting, coloring), warm objects while providing the typical visual details of visual imaging. Consider a soldier wearing a camouflage uniform hiding in vegetation in a tree line. With a visual camera, the soldier may not be perceived by a viewer. With an IR camera, details that, the visual camera can detect may be lost. With the combination of the two cameras, the soldier thermal signature will be detected, and the example systems and methods can "paint" the soldier thermal signature on the image provided by the visual camera. Thus, the viewer will see the scenery in the field of view in detail with the natural color from the visual system, with the thermal signature outline of the soldier enhanced.

Figure 14:
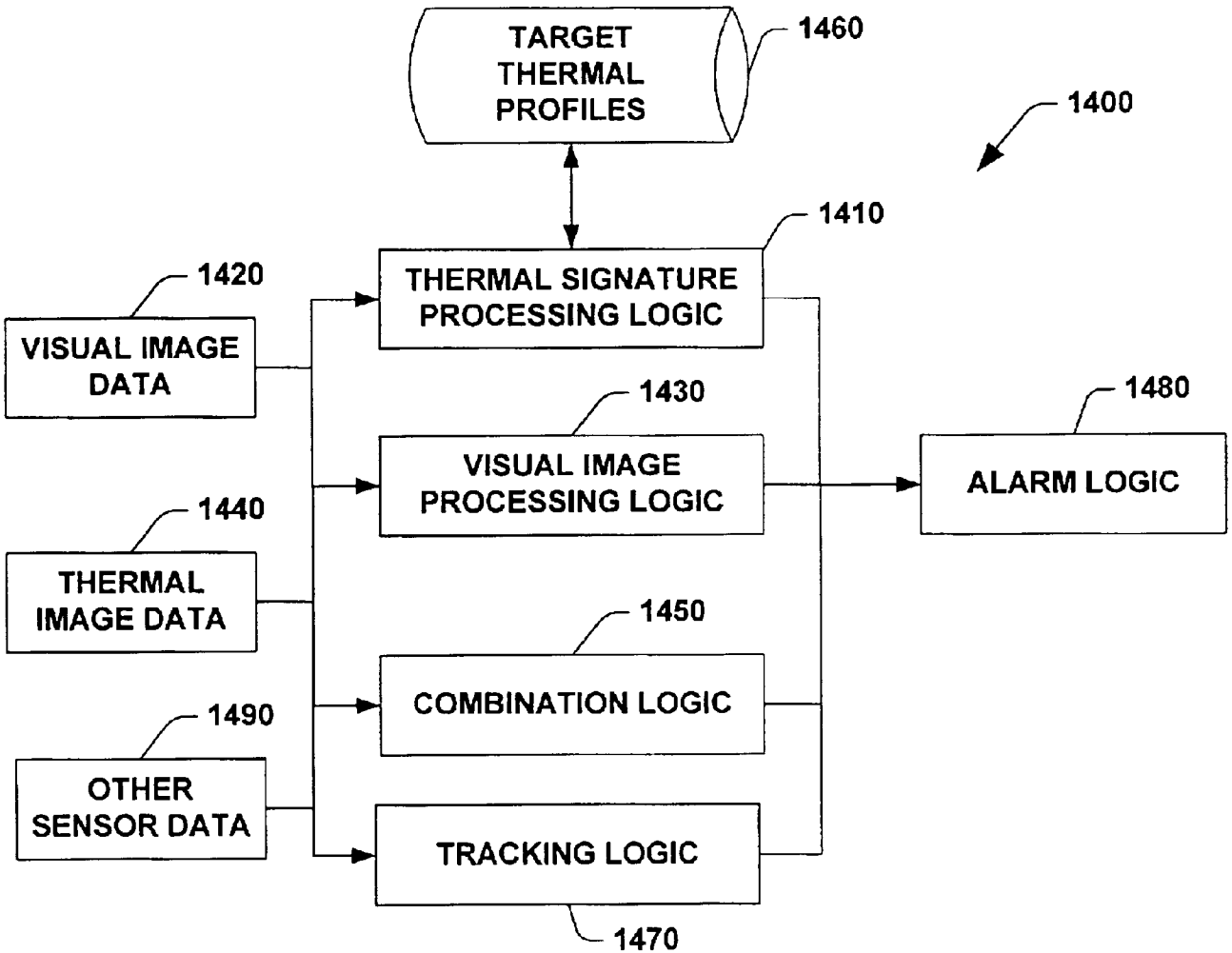
FIG. 14 illustrates an example combined thermal signature intensity and visual image processing system with other sensors and associated tracking logic.

FIG. 14 illustrates an example combined thermal signature intensity and visual image processing system 1400 with other sensors and associated tracking logic. The system 1400 incorporates substantially all the image processing, thermal signature processing, tracking, combination and other logic described above. Additionally, the system 1400 processes other sensor data 1490. The other sensor data 1490 may be acquired from, for example, a listening device, a satellite, a pressure sensor, a chemical sensor, a wind speed sensor, a seismic sensor, and so on. Thus, the system 1400 can perform processing that includes acquiring a thermal image data 1440 and analyzing the thermal image data 1440 to identify a thermal signature intensity for an object of interest in a region of interest. The region of interest may be established manually and/or automatically in response to information processed from the other sensor data 1490. For example, a seismic sensor may identify an event in a location that causes the visual image data acquirer and thermal image data acquirer to scan the location identified by the seismic sensor. Thus, the system 1400 may also perform processing like acquiring a visual image data 1420 and analyzing the visual image data 1420 to facilitate characterizing the object of interest. For example the other sensor data 1490 may have automatically caused the visual image data acquirer and the thermal image data acquirer to scan a region in which an object of interest (e.g., human intruder) is identified. Thus, the tracking logic 1470 can track the object while alarm logic 1480 notifies people and/or processes interested in the alarm situation.

The system 1400 may, with the other sensor data 1490, the visual image data 1420, and the thermal image data 1440 attempt to characterize an object of interest beyond a thermal signature identification. For example, the system 1400 may attempt to perform processing where characterizing an object of interest includes, but is not limited to, identifying a location of the object, identifying a size of the object, identifying the presence of the object, identifying the path of the object, and identifying the likelihood that the object is an intruder for which an alarm signal should be generated.

While combination processing involving IR and visual camera systems have been described above, it is to be appreciated that other sensors can interact with the IR and/or visual camera systems described herein. By way of illustration, example systems and methods can accept inputs from sensors including, but not limited to, PIR, seismic, acoustic, ground search radar, air search radar, satellite imagery, and so on. Presentation apparatus (e.g., computer monitor, television) associated with the example systems and methods can then present an integrated tactical picture that presents data like, the location of a sensor, the direction the sensor is facing, current/historical alarms from a sensor, detected objects, object paths, and so on. The integrated tactical picture may be displayed, for example, on a topographical map, a real-time overhead image, a historical overhead image (e.g., satellite photograph) and so on.

The additional sensors can be employed, for example, to direct thermal and/or visual cameras to areas of interest (e.g., potential intrusion detected site). In this configuration, the example systems and methods with the additional sensors operate with the imaging systems to provide intruder detection and/or threat assessment. Furthermore, data from the additional sensors can be input into an intruder recognition system and/or method to facilitate identifying intruders. By way of illustration, a thermal signature may be combined with a sound signature to facilitate distinguishing between, for example, a truck and a tank.

Figure 15:
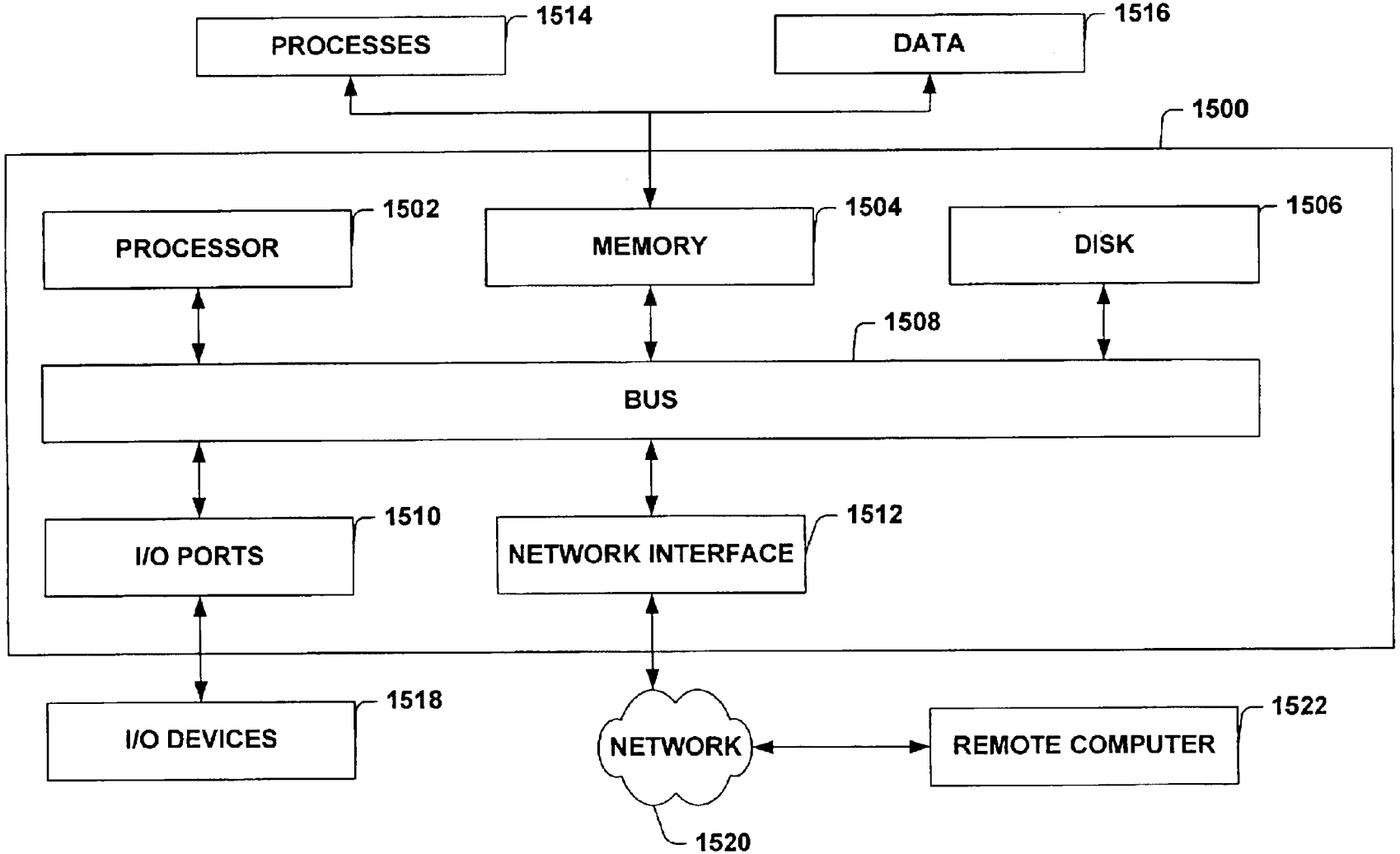
FIG. 15 is a schematic block diagram of an example computing environment with which the example systems and method can interact.

FIG. 15 is a schematic block diagram of an example computing environment with which the example systems and method can interact. FIG. 15 illustrates a computer 1500 that includes a processor 1502, a memory 1504, a disk 1506, input/output ports 1510, and a network interface 1512 operably connected by a bus 1508. Executable components of the systems described herein may be located on a computer like computer 1500. Similarly, computer executable methods described herein may be performed on a computer like computer 1500. It is to be appreciated that other computers may also be employed with the systems and methods described herein.

The processor 1502 can be a variety of various processors including dual microprocessor and other multi-processor architectures. The memory 1504 can include volatile memory and/or non-volatile memory. The non-volatile memory can include, but is not limited to, read only memory (ROM), programmable read only memory (PROM), electrically programmable read only memory (EPROM), electrically erasable programmable read only memory (EEPROM), and the like. Volatile memory can include, for example, random access memory (RAM), synchronous RAM (SRAM), dynamic RAM (DRAM), synchronous DRAM (SDRAM), double data rate SDRAM (DDR SDRAM), and direct RAM bus RAM (DRRAM). The disk 1506 can include, but is not limited to, devices like a magnetic disk drive, a floppy disk drive, a tape drive, a Zip drive, a flash memory card, and/or a memory stick. Furthermore, the disk 1506 can include optical drives like, a compact disk ROM (CD-ROM), a CD recordable drive (CD-R drive), a CD rewriteable drive (CD-RW drive) and/or a digital versatile ROM drive (DVD ROM). The memory 1504 can store processes 1514 and/or data 1516, for example. The disk 1506 and/or memory 1504 can store an operating system that controls and allocates resources of the computer 1500.

The bus 1508 can be a single internal bus interconnect architecture and/or other bus architectures. The bus 1508 can be of a variety of types including, but not limited to, a memory bus or memory controller, a peripheral bus or external bus, and/or a local bus. The local bus can be of varieties including, but not limited to, an industrial standard architecture (ISA) bus, a microchannel architecture (MSA) bus, an extended ISA (EISA) bus, a peripheral component interconnect (PCI) bus, a universal serial (USB) bus, and a small computer systems interface (SCSI) bus.

The computer 1500 interacts with input/output devices 1518 via input/output ports 1510. Input/output devices 1518 can include, but are not limited to, a keyboard, a microphone, a pointing and selection device, cameras, video cards, displays, and the like. The input/output ports 1510 can include but are not limited to, serial ports, parallel ports, and USB ports.

The computer 1500 can operate in a network environment and thus is connected to a network 1520 by a network interface 1512. Through the network 1520, the computer 1500 may be logically connected to a remote computer 1522. The network 1520 can include, but is not limited to, local area networks (LAN), wide area networks (WAN), and other networks. The network interface 1512 can connect to local area network technologies including, but not limited to, fiber distributed data interface (FDDI), copper distributed data interface (CDDI), ethernet/IEEE 802.3, token ring/IEEE 802.5, and the like. Similarly, the network interface 1512 can connect to wide area network technologies including, but not limited to, point to point links, and circuit switching networks like integrated services digital networks (ISDN), packet switching networks, and digital subscriber lines (DSL). Since the computer 1500 can be connected with other computers, and since the systems and methods described herein may include distributed communicating and cooperating computer components, information may be transmitted between these components.

In one example, an IIR module is incorporated into an apparatus that also includes one or more computer components for running associated application software. In another example, an IIR module and one or more computer components are distributed between two or more logical and/or physical apparatus. Thus, the IIR module and the computer components for running associated application software may engage in computer communications across, for example, a computer network. Thus, FIG. 16 illustrates an example data packet.

Figure 16:
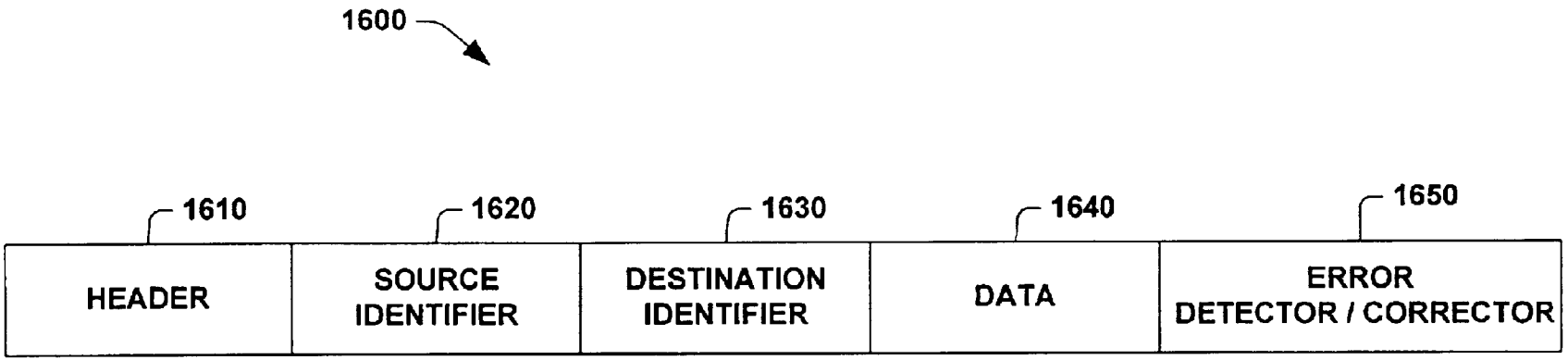
FIG. 16 illustrates an example data packet.

Referring now to FIG. 16, information can be transmitted between various computer components associated with the example systems and methods described herein via a data packet 1600. An exemplary data packet 1600 is shown. The data packet 1600 includes a header field 1610 that includes information like the length and type of packet. A source identifier 1620 follows the header field 1610 and includes, for example, an address of the computer component from which the packet 1600 originated. Following the source identifier 1620, the packet 1600 includes a destination identifier 1630 that holds, for example, an address of the computer component to which the packet 1600 is ultimately destined. Source and destination identifiers can be, for example, globally unique identifiers (guids), URLS (uniform resource locators), path names, and the like. The data field 1640 in the packet 1600 includes various information intended for the receiving computer component. The data packet 1600 ends with an error detecting and/or correcting 1650 field whereby a computer component can determine if it has properly received the packet 1600. While five fields are illustrated in the data packet 1600, it is to be appreciated that a greater and/or lesser number of fields can be present in data packets.

Figure 17:
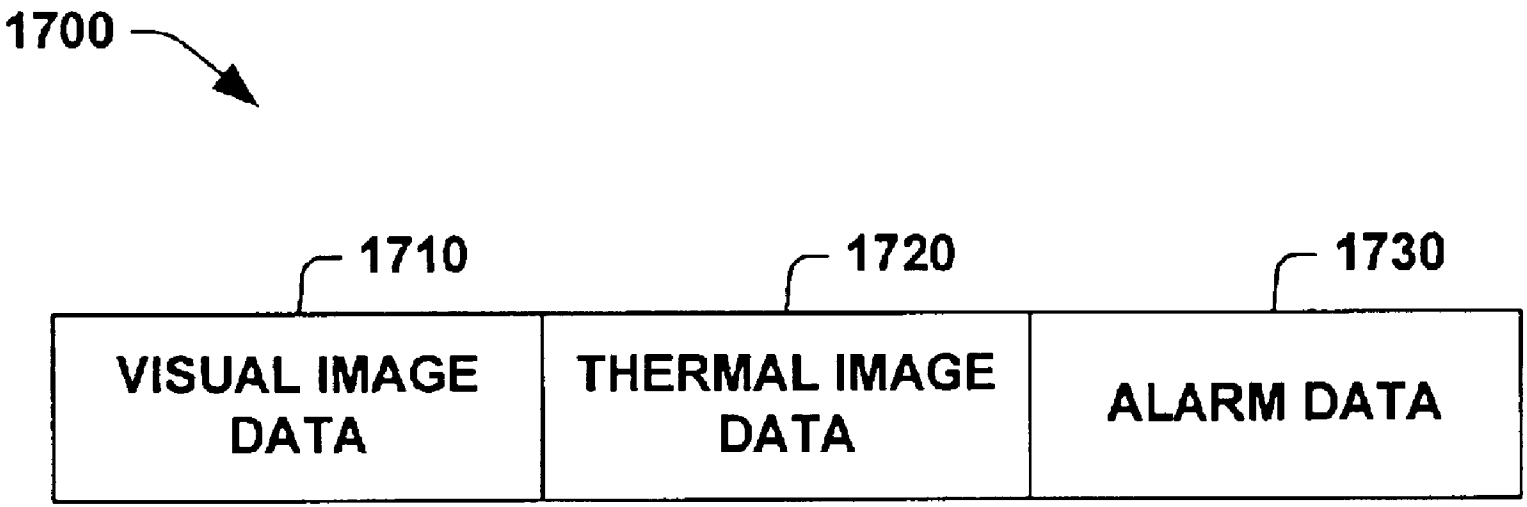
FIG. 17 illustrates example subfields in a data packet.

FIG. 17 is a schematic illustration of sub-fields 1700 within the data field 1640 (FIG. 16). The sub-fields 1700 discussed are merely exemplary and it is to be appreciated that a greater and/or lesser number of sub-fields could be employed with various types of data germane to processing thermal and/or visual image data. The sub-fields 1700 include a field 1710 that holds, for example, information concerning visual image data. The sub-fields 1700 also include a field 1720 that holds, for example, information concerning thermal image data.

Example systems and methods can generate an alarm based on thermal and/or visual image data like that stored in the subfields 1710 and 1720, thus, the sub-fields 1700 include a field 1730 that stores information concerning alarm data 1730 associated with the visual image data in field 1710 and/or the thermal image data in field 1720.

Figure 18:
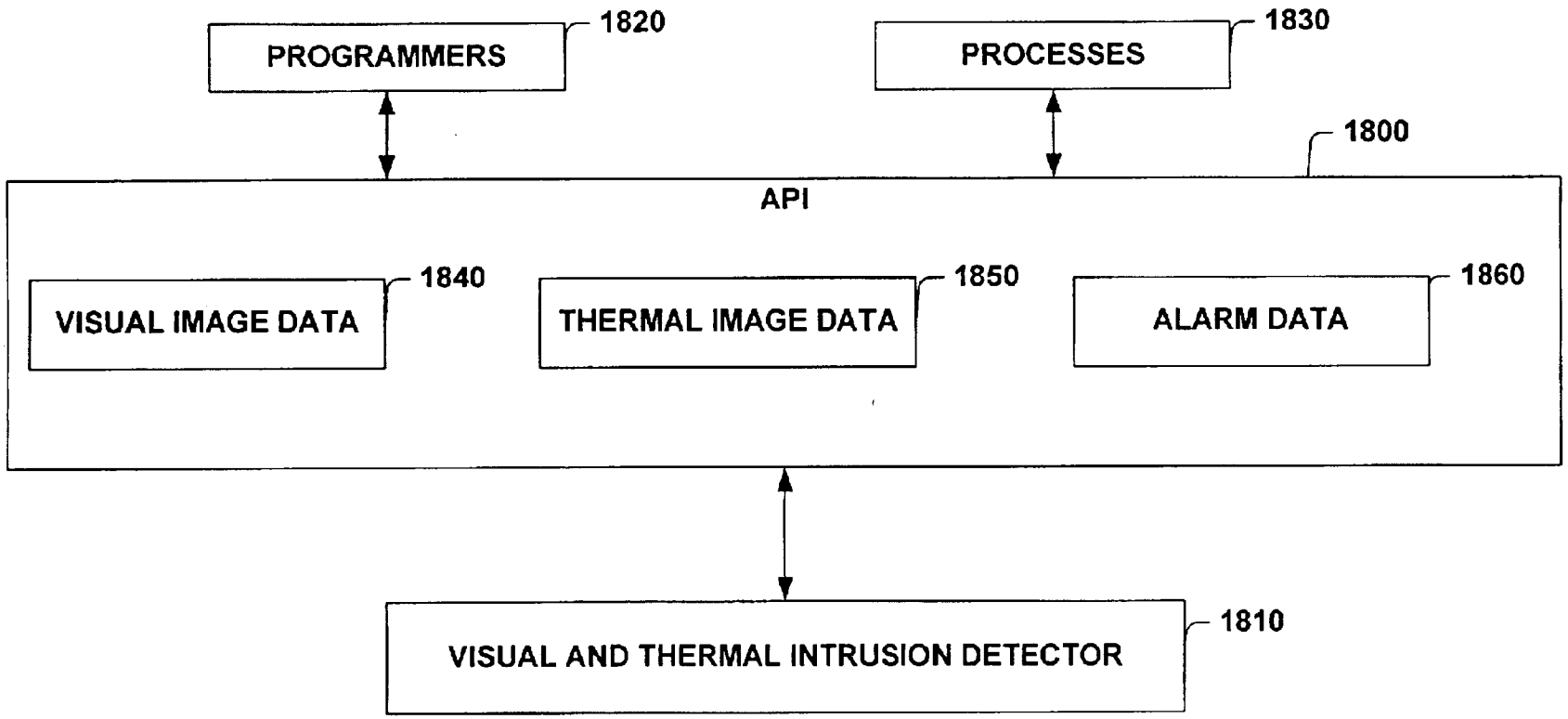
FIG. 18 illustrates an example application programming interface (API).

Referring now to FIG. 18, an application programming interface (API) 1800 is illustrated providing access to a system 1810 for intrusion detection. The API 1800 can be employed, for example, by programmers 1820 and/or processes 1830 to gain access to processing performed by the system 1810. For example, a programmer 1820 can write a program to access the system 1810 (e.g., to invoke its operation, to monitor its operation, to access its functionality) where writing a program is facilitated by the presence of the API 1800. Thus, rather than the programmer 1820 having to understand the internals of the intrusion detection system 1810, the programmer's task is simplified by merely having to learn the interface to the system 1810. This facilitates encapsulating the functionality of the intrusion detection system 1810 while exposing that functionality. Similarly, the API 1800 can be employed to provide data values to the system 1810 and/or retrieve data values from the system 1810. For example, a process 1830 that processes visual image data can provide this data to the system 1810 via the API 1800 by, for example, using a call provided in the portion 1840 of the API 1800. Similarly, a programmer 1820 concerned with thermal image data can transmit this data via a portion 1850 of the interface 1800.

Thus, in one example of the API 1800, a set of application program interfaces can be stored on a computer-readable medium. The interfaces can be employed by a programmer, computer component, and/or process to gain access to an intrusion detection system 1810. Interfaces can include, but are not limited to, a first interface 1840 that communicates a visual image data, a second interface 1850 that communicates a thermal image data, and a third interface 1860 that communicates an alarm data generated from one or more of the thermal image data and the visual image data.

Figure 19:
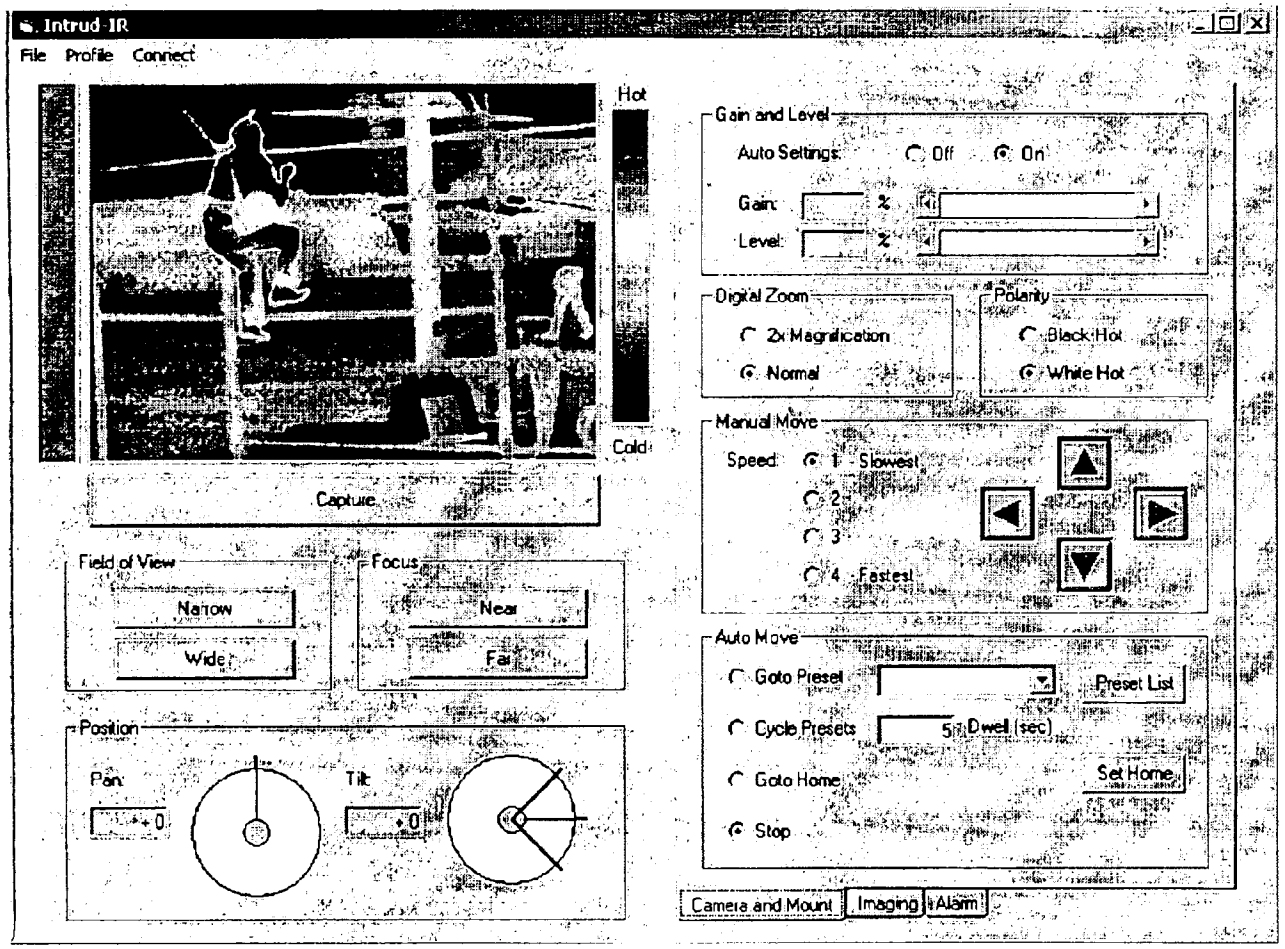
FIG. 19 illustrates an example screen shot from a thermal signature intensity alarming system.
Figure 20:
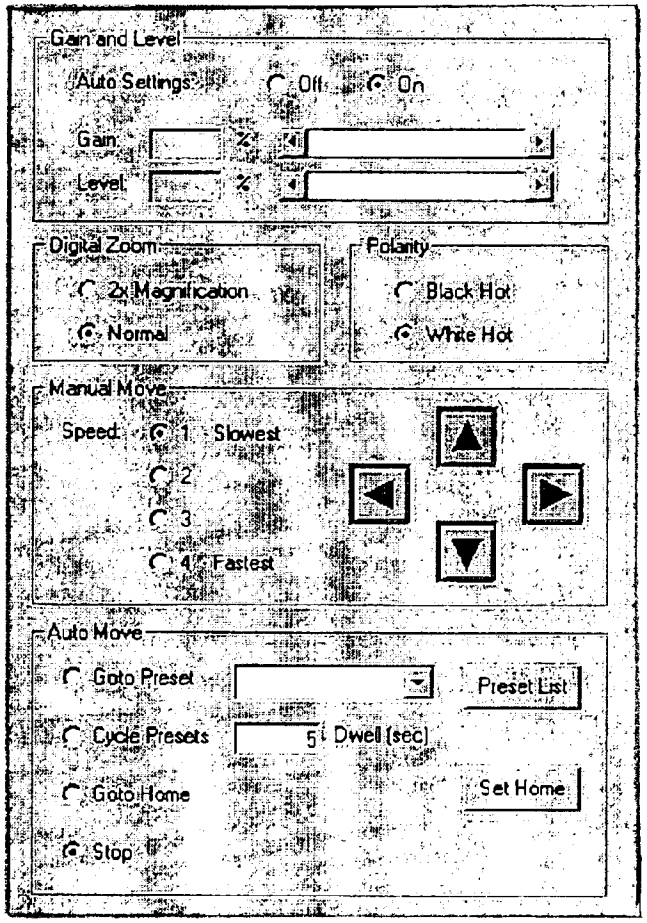
FIG. 20 illustrates an example screen shot from a thermal signature intensity alarming system.
Figure 21:
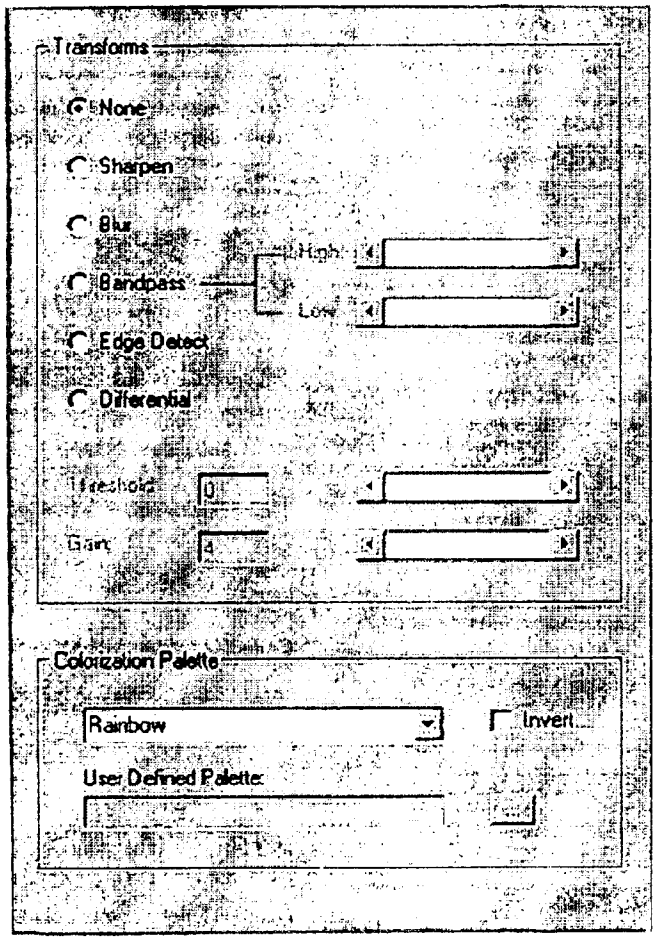
FIG. 21 illustrates an example screen shot from a thermal signature intensity alarming system.
Figure 22:
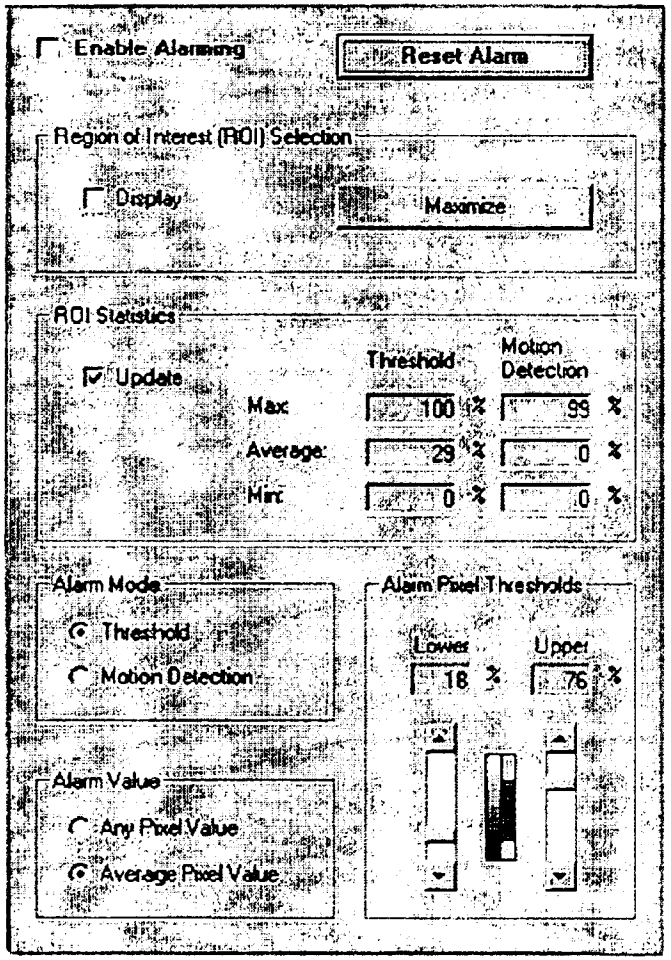
FIG. 22 illustrates an example screen shot from a thermal signature intensity alarming system.

In one example, an infrared and visual intrusion detector provides a graphical user interface through which users can configure various values associated with the intrusion detection. For example, values including, but not limited to, a lower thermal intensity boundary, an upper thermal intensity boundary, a region of interest, a bit depth for color acquisition, a frame size for image acquisition, a frequency of frame capture, a motion sensitivity value, an output display quality and so on can be configured. Thus, FIG. 19 illustrates an example screen shot from a thermal signature intensity alarming system. Similarly, FIGS. 20, 21 and 22 illustrate example screen shots associated with a thermal signature intensity alarming system.

The systems, methods, and objects described herein may be stored, for example, on a computer readable media. Media can include, but are not limited to, an ASIC, a CD, a DVD, a RAM, a ROM, a PROM, a disk, a carrier wave, a memory stick, and the like. Thus, an example computer readable medium can store computer executable instructions for IR intrusion detection systems.

What has been described above includes several examples. It is, of course, not possible to describe every conceivable combination of components or methodologies for purposes of describing the systems, methods, computer readable media and so on employed in IR based intrusion detection. However, one of ordinary skill in the art may recognize that further combinations and permutations are possible. Accordingly, this application is intended to embrace alterations, modifications, and variations that fall within the scope of the appended claims. Furthermore, the preceding description is not meant to limit the scope of the invention. Rather, the scope of the invention is to be determined only by the appended claims and their equivalents.

While the systems, methods and so on herein have been illustrated by describing examples, and while the examples have been described in considerable detail, it is not the intention of the applicants to restrict or in any way limit the scope of the appended claims to such detail. Additional advantages and modifications will be readily apparent to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

To the extent that the term "includes" is employed in the detailed description or the claims, it is intended to be inclusive in a manner similar to the term "comprising" as that term is interpreted when employed as a transitional word in a claim. Further still, to the extent that the term "or" is employed in the claims (e.g., A or B) it is intended to mean "A or B or both". When the author intends to indicate "only A or B but not both", then the author will employ the term "A or B but not both". Thus, use of the term "or" in the claims is the inclusive, and not the exclusive, use. See BRYAN A. GARNER, A DICTIONARY OF MODERN LEGAL USAGE 624 (2d Ed. 1995).

What is claimed is:

1. A system, comprising:

a thermal signature processing logic that analyzes a thermal image data with respect to a background, which has a dynamically changing thermal signature, to identify an object of interest by a thermal signature;

an intensity logic that determines the relative thermal intensity of the object of interest; and an alarm logic that determines whether an alarm-worthy event has occurred based on one or more of the thermal signature processing logic analysis of the thermal image data and the intensity logic analysis of the relative thermal intensity of the object of interest.

2. The system of claim 1, where the alarm logic determines whether an alarm-worthy event has occurred based on one or more values produced by the thermal signature processing logic or the intensity logic where the one or more values are produced by processing the value of an individual pixel or a set of pixels.

3. The system of claim 1, where the alarm logic determines whether an alarm-worthy event has occurred based on one or more values produced by the thermal signature processing logic or the intensity logic where the one or more values are produced by processing the effect an individual pixel or set of pixels has on an average value for a region of interest.

4. A computer readable medium storing computer executable components of the system of claim 1.

5. A system, comprising:

a thermal signature processing logic that analyzes a thermal image data with respect to a background, which has a dynamically changing thermal signature, to identify an object of interest by a thermal signature;

a motion logic that determines whether an object of interest moved; and an alarm logic that determines whether an alarm-worthy event has occurred based on one or more of, the thermal signature processing logic analysis of the thermal image data and the motion logic analysis of the motion of the object of interest.

6. The system of claim 5, where the alarm logic determines whether an alarm-worthy event has occurred based on one or more values produced by the thermal signature processing logic or the motion logic where the one or more values are produced by processing the value of an individual pixel or a set of pixels.

7. The system of claim 5, where the alarm logic determines whether an alarm-worthy event has occurred based on one or more values produced by the thermal signature processing logic or the motion logic where the one or more values are produced by processing the effect an individual pixel or set of pixels has on an average value for a region of interest.

8. A computer readable medium storing computer executable components of the system of claim 5.

9. A system, comprising:

a thermal signature processing logic that analyzes a thermal image data with respect to a background, which has a dynamically changing thermal signature, to identify an object of interest by a thermal signature;

a motion logic that determines whether an object of interest moved;

an intensity logic that determines the relative thermal intensity of the object of interest; and an alarm logic that determines whether an alarm-worthy event has occurred based on one or more of, the thermal signature processing logic analysis of the thermal image data, the motion logic analysis of the motion of the object of interest, and the intensity logic analysis of the relative thermal intensity of the object of interest.

10. The system of claim 9, where the alarm logic determines whether an alarm-worthy event has occurred based on one or more values produced by the thermal signature processing logic, the motion logic, or the intensity logic where the values are produced by processing the value of an individual pixel or a set of pixels.

11. The system of claim 9, where the alarm logic determines whether an alarm-worthy event has occurred based on one or more values produced by the thermal signature processing logic, the motion logic, or the intensity logic where the values are produced by processing the effect an individual pixel or set of pixels has on an average value for a region of interest.

12. A computer readable medium storing computer executable components of the system of claim 9.

13. A system, comprising:

a visual processing logic that analyzes a visual image data;

a thermal signature processing logic that analyzes a thermal image data with respect to a background, which has a dynamically changing thermal signature;

a combination logic that analyzes a combination of the visual image data and the thermal image data or that determines a relation between them; and an alarm logic for determining whether an alarm-worthy event has occurred based on one or more of the visual processing logic analysis of the visual image data, the thermal signature processing logic analysis of the thermal image data, and the combination logic analysis of the combination of the visual image data and the thermal image data or the relation between the visual image data and the thermal image data.

14. The system of claim 13, comprising a frame capturer that captures between 10 and 60 frames per second.

15. The system of claim 14, where the frame capturer is one of a peripheral component interconnect frame grabber and a universal serial bus frame grabber.

16. The system of claim 15, where the peripheral component interconnect frame grabber samples data at a resolution of between 128×128 pixels and 1024×1024.

17. The system of claim 15, where the peripheral component interconnect frame grabber samples data with a color depth of between 4 and 16 bits per pixel.

18. The system of claim 13, where the visual image data is taken from a single frame.

19. The system of claim 13, where the visual image data is taken from two or more frames.

20. The system of claim 13, where the visual processing logic includes a visual image data transforming logic.

21. The system of claim 20, where the visual image data transforming logic performs one or more of, blurring, sharpening, and filtering of the visual image data.

22. The system of claim 13, where the alarm logic determines whether an alarm-worthy event has occurred by evaluating the value of one or more pixels in the visual image data or the thermal image data on an individual basis.

23. The system of claim 13, where the alarm logic determines whether an alarm-worthy event has occurred by evaluating values of a set of pixels in the visual image data or the thermal image data on an averaged basis.

24. The system of claim 13, where the alarm logic determines whether an alarm-worthy event has occurred by comparing a motsig data to a pre-determined, configurable range for the motsig data.

25. A computer readable medium storing computer executable components of the system of claim 13.

26. A method, comprising:

acquiring a thermal image data;

analyzing the thermal image data to identify a thermal signature intensity for an object of interest in a region of interest with respect to a background, which has a dynamically changing thermal signature;

determining whether an alarm signal should be generated based on the thermal signature intensity of the object of interest; and selectively generating an alarm signal.

27. A method, comprising:

acquiring a thermal image data;

analyzing the thermal image data to identify a motion for an object of interest in a region of interest with respect to a background, which has a dynamically changing thermal signature;

determining whether an alarm signal should be generated based on the motion of the object of interest; and selectively generating an alarm signal.

28. A method, comprising:

acquiring a thermal image data;

analyzing the thermal image data with respect to a background, which has a dynamically changing thermal signature, to identify a thermal signature intensity for an object of interest in a region of interest;

analyzing the thermal image data to identify a motion for the object of interest in a region of interest;

determining whether an alarm signal should be generated based on the motion of the object of interest or the thermal signature intensity of the object of interest; and selectively generating an alarm signal.

29. A method, comprising:

acquiring a visual image data;

acquiring a thermal image data;

analyzing the visual image data and the thermal image data with respect to a background, which has a dynamically changing thermal signature, to determine whether an alarm-worthy event has occurred; and selectively generating an alarm signal based on the analyzing of the visual image data and the analyzing of the thermal image data.

30. The method of claim 29, where the visual image data is acquired from a frame grabber.

31. The method of claim 29, where the thermal image data is acquired from an infrared apparatus.

32. The method of claim 29, comprising:

transforming the visual image data by one or more of bluffing, sharpening, and filtering.

33. The method of claim 29, where an alarm signal is generated based on the value of a single pixel.

34. The method of claim 29, where an alarm signal is generated based on the average value of a set of two or more pixels.

35. The method of claim 29, where an alarm signal is generated based on data from a single frame.

36. The method of claim 29, where an alarm signal is generated based on data from a set of two or more frames.

37. A computer readable medium storing computer executable instructions operable to perform computer executable aspects of the method of claim 29.

38. A method, comprising:

acquiring a thermal image data;

analyzing the thermal image data to identify a thermal signature intensity for an object of interest in a region of interest with respect to a background, which has a dynamically changing thermal signature;

acquiring a visual image data;

generating a presentation of the visual image data where the presentation includes enhancing one or more objects whose thermal signature intensity is within a pre-determined, configurable range.

39. A computerized method, comprising:

acquiring a thermal image data;

analyzing the thermal image data to identify a thermal signature for an object of interest in a region of interest with respect to a background, which has a dynamically changing thermal signature;

accessing a data store of thermal signatures; and generating a target identification based on comparing the identified thermal signature to one or more thermal signatures in the data store.

40. The method of claim 39, comprising:

acquiring a visual image data;

analyzing the visual image data in light of the target identification to refine the target identification.

41. The method of claim 40, comprising:

selectively generating an alarm signal based on the target identification.

42. A method, comprising:

acquiring a thermal image data from a thermal image data device;

analyzing the thermal image data to identify a thermal signature for an object of interest in a region of interest with respect to a background, which has a dynamically changing thermal signature; and selectively controlling the thermal image data device to track the object of interest based on the thermal signature.

43. The method of claim 42, comprising:

automatically focusing the thermal image data device based on the thermal signature for the object of interest.

44. The method of claim 43, where automatically focusing the thermal image data device comprises maximizing a gradient between the object of interest and a background.

45. A method, comprising:

acquiring a thermal image data;

analyzing the thermal image data to identify a thermal signature intensity for an object of interest in a region of interest with respect to a background, which has a dynamically changing thermal signature;

acquiring a visual image data;

analyzing the visual image data to facilitate characterizing the object of interest; and acquiring one or more external sensor data that further facilitate characterizing the object of interest.

46. The method of claim 45, where characterizing an object of interest comprises one or more of, identifying a location of the object, identifying a size of the object, identifying the presence of the object, identifying the path of the object, and identifying the likelihood that the object is an intruder for which an alarm signal should be generated.

47. A system for detecting an intrusion of an object of interest into a region of interest, comprising:

means for acquiring a thermal image of the region of interest with respect to a background, which has a dynamically changing thermal signature;

means for analyzing the thermal image to identify a thermal intensity signal of an object of interest; and means for generating an alarm signal based on the analysis of the thermal image.

48. A system for detecting an intrusion of an object of interest into a region of interest, comprising:

means for acquiring a visual image of the region of interest;

means for acquiring a thermal image of the region of interest;

means for analyzing the visual image in relation to the thermal image with respect to a background, which has a dynamically changing thermal signature; and means for generating an alarm signal based on the analysis of the visual image in relation to the thermal image.

49. A set of application programming interfaces embodied on a computer readable medium for execution by a computer component in conjunction with intrusion detection, comprising:

a first interface for communicating thermal image data determined with respect to a background, which has a dynamically changing thermal signature; and a second interface for communicating alarm data, where the alarm data is computed based on analyzing the thermal image data.

50. In a computer system having a graphical user interface comprising a display and a selection device, a method of providing and selecting from a set of data entries on the display, the method comprising:

retrieving a set of data entries, each of the data entries representing one of an action associated with detecting an intrusion by analyzing thermal image data with respect to a background, which has a dynamically changing thermal signature;

displaying the set of entries on the display;

receiving a data entry selection signal indicative of the selection device selecting a selected data entry; and in response to the data entry selection signal, initiating an operation associated with the selected data entry.

51. A computer data signal embodied in a transmission medium, comprising:

a first set of instructions for processing thermal image determined with respect to a background, which has a dynamically chancing thermal signature; and a second set of instructions for determining that an intrusion by an object of interest into a region of interest has occurred based on processing of the thermal image data.

52. A data packet for transmitting intrusion data, comprising:

a first field that stores thermal image data determined with respect to a background, which has a dynamically changing thermal signature; and a second field that stores alarm data computed from analyzing the thermal image data.

* * * * *